US005689751A

United States Patent [19]

Ueda

[11] Patent Number: 5,689,751

[45] Date of Patent: Nov. 18, 1997

[54] AUTOMATIC PROCESSOR FOR SILVER HALIDE PHOTOGRAPHIC LIGHT-SENSITIVE MATERIAL

[75] Inventor: Yutaka Ueda, Hino, Japan

[73] Assignee: Konica Corporation, Tokyo, Japan

[21] Appl. No.: 565,339

[22] Filed: Nov. 30, 1995

[30] Foreign Application Priority Data

Dec. 6, 1994 [JP] Japan ..... 6-302275

[51] Int. Cl.[6] ..... G03D 3/02

[52] U.S. Cl. ..... 396/626; 396/630

[58] Field of Search ..... 354/322, 324; 430/30, 398–400, 450, 465; 396/626, 630, 636, 617

[56] References Cited

U.S. PATENT DOCUMENTS

| | | | |
|---|---|---|---|
| 3,995,298 | 11/1976 | Vandeputte et al. | 354/324 |
| 5,043,756 | 8/1991 | Takabayashi et al. | 354/320 |
| 5,398,094 | 3/1995 | Rosenburgh et al. | 354/324 |
| 5,436,118 | 7/1995 | Carli et al. | 354/324 X |
| 5,452,045 | 9/1995 | Koboshi et al. | 396/626 |

FOREIGN PATENT DOCUMENTS

| | | | |
|---|---|---|---|
| 0 537 365 | 4/1993 | European Pat. Off. | 396/942 |
| 0 623 844 | 11/1994 | European Pat. Off. | 396/942 |
| WO 91/12567 | 8/1991 | WIPO | 396/942 |

*Primary Examiner*—D. Rutledge

*Attorney, Agent, or Firm*—Frishauf, Holtz, Goodman, Langer & Chick, P.C.

[57] ABSTRACT

An automatic processor for processing a silver halide photographic light-sensitive material with a processing solution, includes a processing tank containing the processing solution for processing the material; and a circulating path for circulating the processing solution, which communicates with the processing tank. The processor further includes a supplier for supplying a solid composition to the processing tank or the path, in which the expression of $V_w \leqq Vf$ is satisfied, where $V_w$ represents an amount (liter) of the processing solution in a minute in the processing tank and Vf represents an amount (liter) of the processing solution in the path.

20 Claims, 18 Drawing Sheets

AUTOMATIC PROCESSOR FOR SILVER HALIDE PHOTOGRAPHIC LIGHT-SENSITIVE MATERIAL

The present invention relates to an automatic processing machine for silver halide photographic light-sensitive material.

Recently, a technology which solidifies a processing agent for silver halide photographic light-sensitive material and replenishes processing agent components by supplying them directly to a processing tank (example: Japanese Patent Publication Open to Public Inspection (hereinafter, referred to as Japanese Patent O.P.I. Publication) No. 119454/1993) was disclosed.

On the other hand, in addition, technologies which increase circulation speed of a solution and conduct photographic processing more rapidly have also been disclosed.

In a developing tank where the silver halide photographic light-sensitive material is subjected to photographic processing, a processing solution is circulated to improve developing properties due to solution stirring. Therefore, oxidizing of a developing agent (specifically, a color developing agent) due to air is easily promoted. In addition, a surfactant diluted from the silver halide photographic light-sensitive material processed is carried in bubbled to the processing solution. Therefore, oxidation of the color developing agent in the processing solution due to air is unfortunately further promoted. Specifically, when the amount of the silver halide photographic light-sensitive material processed per day is small, renewal of a processing agent component is not proceeded so that oxidized products of the developing agent is accumulated while a new processing agent is not replenished, resulting in deterioration of image quality on low density portions (specifically, white portions on a photographic paper) of the silver halide photographic light-sensitive material being developed due to dyeing of the oxidized product of the developing agent to the light-sensitive material and reduction of developing processability due to the developing of the developing agent.

It was discovered that the above-mentioned problems cannot be solved only by the use of the above-mentioned solid processing agent and by replenishing the processing agent component by supplying the processing agent directly to the processing tank.

SUMMARY OF THE INVENTION

A first object of the present invention is to solve the problem of deterioration of the low density portion of the light-sensitive material due to dyeing of the oxidized product of the above-mentioned developing agent and the problem of reduction of development processability due to the development of the developing agent. Specifically, this first object is useful when the daily amount of silver halide photographic light-sensitive material processed is small.

In addition, it was discovered that, when the aperture area ratio of a developing tank is simply reduced, the aperture portion of the photographic processing tanks becomes small, resulting in difficult maintenance of the photographic processing tanks.

A second object of the present invention is to reduce the degree of difficulty of maintenance of the photographic processing tank even when the aperture area ratio of the developing tanks is extremely reduced.

Incidentally, it turned out that, when circulation speed of the developing solution is simply increased for more rapid photographic processing, development unevenness tends to occur.

A third object of the present invention is to prevent the occurrence of development unevenness even when circulation speed of the developing solution is simply increased for more rapid photographic processing.

Operators are requested to daily clean cross-over rollers which convey the silver halide photographic light-sensitive material from the photographic processing tank to its succeeding step after the daily use of the automatic processing machine. However, many operators do not perform cleaning. When the cross-over rollers are not cleaned, a developing solution which is conveyed by the silver halide photographic light-sensitive material and remains on the cross-over rollers is oxidized to be deformed or crystallized. This deformed product and crystallized material adheres on the silver halide photographic light-sensitive material developed, which therefore loses all commercial value.

A fourth object of the present invention is to prevent the occurrence of the problem that the developing solution which remains on the cross-over rollers are oxidized to be deformed or crystallized so that these deformed product and crystallized material adheres on the silver halide photographic light-sensitive material developed, losing all commercial value, even when an operator does not clean the cross-over rollers.

The above-mentioned objects are attained by a constitution having the following embodiments.

The first embodiment will be explained bellow. In a conventional apparatus which develops the silver halide photographic light-sensitive material, the volume of the developing solution housed in a photographic developing solution tank Vw (liter) and the volume of the developing solution in a circulation route Vf (liter) satisfies $Vw>Vf$. Therefore, to satisfy $Vw \leqq Vf$, namely to enlarge the volume of the developing solution in a circulation route than the volume of a developing solution housed in a photographic developing solution tank could not be imagined. Due to satisfying this novel $Vw \leqq Vf$, the present inventors discovered that, in a photographic processing tank where the silver halide photographic light-sensitive material is immersed in a developing solution for photographic processing, improvement in development processability is compatible with reduction of oxidization of the developing agent due to air in the circulation route so that the present invention was attained. Namely, due to a silver halide photographic light-sensitive material having a photographic processing tank housing the developing solution and immersing the silver halide photographic light-sensitive material for photographic processing, a circulation route which communicates with the above-mentioned photographic processing tank and in which the developing solution circulates and a solid processing agent supplying means which supplies the solid processing agent to the above-mentioned photographic processing tank or the above-mentioned circulation route, wherein, when the silver halide photographic light-sensitive material is subjected to photographic processing, the volume of a developing solution housed in a photographic developing solution Vw (liter) and the volume of the developing solution in a circulation route Vf (liter) satisfies $Vw \leqq Vf$, the speed of the processing solution in the photographic processing tank is increased and that in the circulation route is decreased so that, in the photographic processing tank which immerses the silver halide photographic light-sensitive material into the developing solution for photographic processing, improvement of development processability can be compatible with reduction of oxidation of the developing agent due to air in the circulation route. In addition, due to this, volume of the photographic processing tank can be reduced so that the speed of the flow of the processing solution inside the photographic processing tank can be increased, without using a processing solution circulation means having high ability to circulate the developing solution. Thus, simplifying the apparatus and cost down becomes possible.

In addition, with regard to supply of the solid processing agent by means of a solid processing agent supplying means, since a filter is provided in the circulation route where the developing solution is circulated for the filtration of the developing solution, it is preferable that the solid processing agent is supplied before the filter of the circulation route.

When photographic processing time is 18 second or less, the density of developing agent is high so that effect to developerbility is large. Therefore, the present invention is useful. In order to cause development reaction sufficiently, the photographic processing time is preferably 5 seconds or more.

In addition, the present inventors discovered that stable photographic processing stability is obtained even in the case that the photographic processing time is 18 seconds or less, when the ratio of a unit supplying amount of the solid processing agent per one time A (g) and the volume of the developing solution housed in the photographic processing tank and a portion which is communicated with the photographic developing tank Vt satisfies $A/Vt<5$. The present inventors discover that color developing properties against the fluctuation of the density of developing agent is stable when the photographic processing time exceeds 18 seconds and that the color developing properties against the fluctuation of the density of developing agent is stable when the photographic processing time is not more than 18 seconds. The present inventor also discovered that the fluctuation of the density of developing agent can be reduced when $A/Vt<5$ for attaining the present invention. More specifically, it is preferable that $A/Vt\leqq 3$ for reducing the fluctuation of the density of developing agent.

In order to attain 18 seconds or less as a development processing time, the density of the developing agent in the developing tank must be increased. Therefore, the developing agent tends to be oxidized. As is shown in conventional developing tanks, when the ratio of the volume of a developing solution, housed in the developing tank and the portion communicating with the developing tank Vt (liter) and the amount of replenisher water replenished for dissolving a solid processing agent replenished per 1 $m^2$ of a silver halide color photographic light-sensitive material C (liter) (Vt/C) is large, the ratio of the color developing processing agent renewed every time the light-sensitive material per unit area (the processing renewal ratio) decreased. Therefore, the oxidized product of the color developing agent tends to be accumulated. However, when $Vt/C<100$ is satisfied, the ratio of the color developing processing agent renewed every time the light-sensitive material per unit area (the processing renewal ratio) increases. Therefore, an oxidized product of the color developing agent is difficult to be accumulated.

The second embodiment of the present invention is preferably:

The automatic processing machine described in the first embodiment for silver halide photographic light-sensitive material having a developing solution housing tank which houses the developing solution and a processing solution circulating means which circulates a developing solution in the above-mentioned circulation route.

In addition, when the developing solution housing tank houses the developing solution air-tightly from ambient air, it is preferable that oxidation and evaporation of the developing solution can be prevented.

The third embodiment of the present invention is that, due to the automatic processing machine described in the 1st or 2nd embodiment wherein the circulation flow rate Vc of a developing solution which circulates in the above-mentioned circulation route Vc (liter/min.) and the volume of the developing solution housed in the above-mentioned developing tank Vw (liter) satisfies $$5\times Vw\leqq Vc\leqq 40\times Vw$$

further stable processing performance can be maintained. Namely, by satisfying $5\times Vw\leqq Vc$ (specifically, $10\times Vw\leqq Vc$), sufficient development processbility can be provided without causing uneven development. In addition, by satisfying $Vc\leqq 40\times Vw$ (specifically, $Vc\leqq 20\times Vw$), oxidation of the developing agent in the developing solution due to air contact can be inhibited. Therefore, reduction of development procesability due to the reduction of the developing agent can be prevented.

The fourth embodiment of the present invention can provide the effect of the present invention more specifically due to the automatic processing machine for a silver halide photographic light-sensitive material described in either embodiment 1 through 3 wherein the circulation flow rate of the developing solution which circulates the above-mentioned circulation route Vc (liter/min.) and the total feeding-in cross sectional area at the feeding-in port of the developing solution which circulates the above-mentioned developing tank Se ($cm^2$) satisfies $$0.5\times Se\leqq Vc\leqq 5\times Se$$

when the silver halide photographic light-sensitive material is developed.

Specifically, $Se\leqq Vc$ is preferable, and $Vc\leqq 3\times Se$ is more preferable.

The fifth embodiment is that, due to the automatic processing machine for a silver halide photographic light-sensitive material described either in embodiment 1 through 4 having a conveyance means which passes in a developing tank and conveys a silver halide photographic light-sensitive material wherein the form of processing tank in the developing tank follows the conveyance route of the silver halide photographic light-sensitive material the processing solution is present only in the vicinity of conveyance route of the silver halide photographic light-sensitive material. Therefore, the volume of the developing solution housed in the developing tank Vw can be greatly reduced, the speed of the developing solution on the silver halide photographic light-sensitive material processed can be increased and the development processability can be improved. In addition, the volume of developing solution housed in the developing tank. Therefore, the renewal ratio of the developing solution in the developing tank can be increased, accumulation of an oxidized product of the developing agent can be inhibited and stable developing processability can be kept. Accordingly, the effects of the present invention can be provided more preferably.

The sixth embodiment of the present invention is that, due to the automatic processing machine for a silver halide photographic light-sensitive material described in embodiment 5, wherein a part of an inner wall of the developing tank also serves as a conveyance guide of the silver halide photographic light-sensitive material the processing solution is present only in the vicinity of the conveyance route for the silver halide photographic light-sensitive material, the effect of the present invention can be provided epecifically more preferably due to the above-mentioned reason. In addition, when the conveyance guide is not provided Separately, the silver halide color photographic light-sensitive material can be conveyed more smoothly.

The seventh embodiment of the present invention is that, due to the automatic processing machine for a silver halide photographic light-sensitive material described in either embodiment 1 through six, wherein the feeding ports of the developing solution which circulates in the above-mentioned developing processing tank, are made of nozzles which spray the processing solution onto the light-sensitive surface of the silver halide photographic light-sensitive material.

The flow rate of the developing solution on the light-sensitive surface of the silver halide photographic light-sensitive material processed can be increased, whereby permeability of developing components such as developing agents to the light-sensitive material is improved so that more sufficient developing processability can be provided.

The eighth embodiment of the present invention is that, due to the automatic processing machine for a silver halide photographic light-sensitive material having a conveyance means which conveys a silver halide photographic light-sensitive material along a prescribed conveyance route in a developing tank described in embodiment 7, wherein the form of the above-mentioned nozzle is multiple holes or slits and the angle formed in the direction of the developing solution fed in from the above-mentioned feeding port and a direction of the conveyance of the silver halide photographic light-sensitive material by means of the above-mentioned conveyance meansis 30° or more and 150° or less.

it is considered that development inhibiting components existing in the vicinity of the light-sensitive surface of the silver halide photographic light-sensitive material processed is flown off, development processability is remarkably improved.

Incidentally, the size of the multiple hole nozzles is preferably 0.5 mm or more in terms of diameter, and also preferably 5 mm or less. To the contrary, the size of the slit nozzles is preferably 0.5 mm or more in terms of width, and also preferably 5 mm or less.

The ninth embodiment is that, due to the automatic processing machine for a silver halide photographic light-sensitive material described in embodiment 7 or 8 having a conveyance means which conveys a silver halide photographic light-sensitive material along a prescribed conveyance route in the developing tank and having at least two parallel rows of nozzles and oriented a vertical to the conveyance surface of the silver halide photographic light-sensitive material, wherein each adjacent nozzle row are offset from each other, the occurrence of streaks development unevenness parallel to the direction of conveyance of the silver halide photographic light-sensitive material can be prevented.

The tenth embodiment is that, due to the automatic processing machine for a silver halide photographic light-sensitive material described in embodiment either 1 through 9 having a conveyance means which conveys a silver halide photographic light-sensitive material along a prescribed conveyance route in a developing tank, wherein the feeding-in port of the developing solution which circulates the above-mentioned developing tank is distributed almost throughout the above-mentioned conveyance route, the effects of the present invention can be provided more preferably.

The eleventh embodiment is that, due to the automatic processing machine for a silver halide photographic light-sensitive material described in either embodiment 1 through 10, wherein the aperture area ratio N of the above-mentioned developing solution N is 12 ($cm^2$/liter) or less, provided that the aperture area ratio N is defined to be St/Vt (St: the total liquid/gas interface area of the developing solution housed in the developing tank and a portion communicating the developing tank ($cm^2$), Vt: volume of the developing solution housed in the developing tank and a portion communicating the developing tank (liter)

oxidation of the developing agent in the processing solution can be inhibited.

The twelfth embodiment is, due to the automatic processing machine for a silver halide photographic light-sensitive material described in either embodiment 1 through 11, wherein the circulation flow rate of the developing solution which circulates the above-mentioned circulation route Vc (liter/minute) is variable depending upon operation status, when the silver halide photographic light-sensitive material is processed inside the developing tank, the amount of circulation flow rate can be increased for enhancing developerbility. When the solid processing agent is supplied or replenishing water is supplied while the silver halide photographic light-sensitive material is not processed inside the developing tank, the occurrence of uneven density can be prevented by a slight circulation flow to an extent that the oxidation of the developing agent is not advanced. As a method to vary the flow rate of the circulation flow caused by the processing solution circulation means depending upon the operation status, a propeller type pump wherein the speed of a propeller as a processing solution circulation means is variable as cited.

The thirteenth embodiment is the automatic processing machine for a silver halide photographic light-sensitive material described either embodiment 1 through 12 above characterized in having a replenishing water supplying means which supplies replenishing water to the above-mentioned developing tank or the above-mentioned circulation route.

The fourteenth embodiment is, due to the automatic processing machine for a silver halide photographic light-sensitive material described in embodiment 13 above, characterized in having a replenishing water heating means which heats replenishing water supplied by the above-mentioned replenishing water supplying means, replenishing water is heated so that the stability of the liquid temperature of the developing solution inside the developing tank can be maintained and, thereby, development stability can be obtained.

The fifteenth embodiment is that, due to the automatic processing machine described in embodiment 13 or 14 above, wherein there is a cross-over roller for conveying a silver halide photographic light-sensitive material from the above-mentioned developing tank to a post-processing step at a communication place above the above-mentioned developing tank and the above-mentioned replenishing water supplying means supplies replenishing water to the above-mentioned cross-over roller, the developing water adhering on the crosseover roller can be cleaned by this replenishing water. Therefore, unless the operator does not take up the cross-over roller every day for cleaning, the occurrence of the crystals and the insoluble on the surface of the roller can be prevented. In addition, since the occurrence of the crystals and the insoluble on the surface of the roller can be prevented, deterioration of the image at a low density portion of the silver halide photographic light-sensitive material due to oxidation of the developing agent and the reduction of development processability due to the reduction of the developing agent can be prevented so that stable processability can be maintained.

The sixteenth embodiment is that, due to an automatic processing machine for a silver halide photographic light-sensitive material which develops a silver halide photographic light-sensitive material with a developing solution, wherein there is a developing tank for housing the developing solution and for immersing the silver halide photographic light-sensitive material in the developing solution, a conveyance means for conveying the silver halide photographic light-sensitive material along a prescribed conveyance route in the developing tank, and, nozzles which spray the developing solution onto a light-sensitive surface of the silver halide photographic light-sensitive material which is conveyed along a prescribed conveyance route in the developing tank, and also, there are at least two nozzle rows in which plural of the above-mentioned nozzles are provided horizontally with the conveyance surface of the silver halide photographic light-sensitive material and vertical to the conveyance direction, and nozzle rows adjoining each other are located in an off-set manner, the occurrence of development uneven streak in a parallel direction to the conveyance direction of the silver halide photographic light-sensitive material can be prevented.

The seventeenth embodiment is that, due to an automatic processing machine for a silver halide photographic light-sensitive material which develops the silver halide photographic light-sensitive material with the developing solution, wherein there is a developing tank for housing the developing solution and for immersing the silver halide photographic light-sensitive material for developing, a conveyance means for conveying the silver halide photographic light-sensitive material along the prescribed conveyance route in the developing tank, and, a lid member for substantially interrupting the developing solution inside the developing tank from an ambient outer air, the above-mentioned lid member constitutes a part of the above-mentioned conveyance route and has an in-feed port and out-feed port for the silver halide photographic light-sensitive material, the developing is substantially interrupted from the ambient outer air by means of the lid member which constitutes a part of the above-mentioned conveyance route and which has an in-feed port and an out-feed for the silver halide photographic light-sensitive material. Therefore, there is substantially no liquid/gas interface other than the in-feed port and the out-feed port so that the area of the liquid/gas interface of the developing solution housed in the developing tank can markedly be reduced. As a result, oxidation of the developing agent can noticeably be inhibited.

The eighteenth embodiment is that, due to the automatic processing machine for the silver halide photographic light-sensitive material described in embodiment 17 above, wherein the above-mentioned lid member is replaceable from the above-mentioned developing tank, maintenance inside the developing tank becomes easier.

The nineteenth embodiment is that, due to the automatic processing machine for the silver halide photographic light-sensitive material described in either embodiment 17 or 18 above, wherein the above-mentioned lid member has a packing member at a place where contacting the above-mentioned developing tank, it is so preferable that liquid leakage due to waving of the processing solution.

The twentieth embodiment is that, due to the automatic processing machine for the silver halide photographic light-sensitive material described in either embodiment 17 or 18 above, wherein the above-mentioned developing tank has a packing member at a place where contacting the above-mentioned developing tank, it is so preferable that liquid leakage due to waving of the processing solution.

The twenty-first embodiment is that, due to the automatic processing machine for the silver halide photographic light-sensitive material described in either embodiment 17 through 20 above, wherein there is a movable interrupting means which substantially interrupts the developing solution from ambient air at an in-feed port for the silver halide photographic light-sensitive material of the above-mentioned lid member when the silver halide photographic light-sensitive material does not pass, the in-feed port substantially interrupts the developing solution from the ambient air when the silver halide photographic light-sensitive material does not pass the in-feed port. Therefore, the area of the liquid/gas interface of the developing solution housed in the developing tank can markedly be reduced. As a result, oxidation and evaporation of the developing agent can noticeably be inhibited.

The twenty-second embodiment is that, due to an automatic processing machine for the silver halide photographic light-sensitive material which develops the silver halide photographic light-sensitive material with the developing solution, wherein there is a developing tank for housing the developing solution and for immersing the silver halide photographic light-sensitive material with the developing solution for photographic processing, a conveyance means which conveys the silver halide photographic light-sensitive material along the prescribed conveyance route in the developing tank, a cross-over rollers for conveying the silver halide photographic light-sensitive material from the above-mentioned developing tank to the post-processing step, and, a replenishing water supplying means for supplying replenishing water to the above-mentioned cross-over rollers, and replenishing water supplied from the above-mentioned replenishing water supplying means is supplied to the above-mentioned developing tank through the above-mentioned cross-over rollers, the developing solution which adheres on the cross-over rollers can be cleaned by this replenishing water. Therefore, unless the operator takes up the cross-over roller every day for cleaning, the occurrence of the crystals and insoluble on the surface of the rollers can be prevented. Accordingly, deterioration of image at a low density portion of the silver halide photographic light-sensitive material due to the developing agent and reduction of the development processability due to the reduction of the developing agent can be prevented so that stable processability can be maintained.

The twenty-third embodiment is that, due to the automatic processing machine for the silver halide photographic light-sensitive material described in embodiment 22 above, wherein the above-mentioned cross-over rollers are constituted by a pair of countering rollers, the cross-over rollers can be cleaned by means of a simple device.

The twenty-fourth embodiment is that, due to the automatic processing machine for the silver halide photographic light-sensitive material described in either embodiment 22 or 23, wherein the replenishing water is supplied from the above-mentioned replenishing water supplying means to the cross-over rollers through the nozzles, the replenishing water can be supplied to the cross-over roller with a strong pressure. As a result, cleaning effect can be enhanced. These nozzles should be positioned throughout the lateral direction. In addition, it is preferable that these nozzles are positioned uniformly throughout the lateral direction. The form of these nozzles may be in a multiple hole form or in a slit form.

The twenty-fifth embodiment is that, due to the automatic processing machine for the silver halide photographic light-sensitive material described in either of embodiment 22 through 24, wherein at least a part of the replenishing water supplied from the above-mentioned replenishing water supplying means is generated by means of a moisture in water separating means, replenishing amount of the replenishing water can be reduced. As the moisture in water separating means, a commercially available dehumidifier can be used. In addition, it is also possible to use a device which coagulates gas by means of a heat pump or an electron chilling element (specifically, a Peltier element). In addition, it is also possible to use a device wherein moisture is removed by means of a semi-permeating membrane which separates vapor from gas.

When the replenishing water is supplied from the replenishing water tank by means of the above-mentioned replenishing water supplying means, water can be fed from the moisture in gas separating means. Therefore, by operating the moisture in gas separating means, water generated by means of the moisture in gas separating means can be supplied in a small amount for a long time.

Due to this, against the decrease of water inside the replenishing water tank which occurs in accordance with the processing of the light-sensitive material, water is supplied small by small by compensating the part thereof. Therefore, compared to a case where tap water is supplied to the replenishing water tank at once in a large amount, the width of the fluctuation of the amount of replenishing water stored in the replenishing water tank can be reduced. Accordingly, it becomes possible to markedly reduce the maximum water storage amount when the number of light-sensitive material processing is the same.

As a result, renewal ratio of water inside the replenishing water tank can be enhanced so that problems of the above-mentioned occurrence of water dust and contamination of water can noticeably be inhibited. In addition, due to this, offensive odor does not occur, no clogging of pumps and filters occur. In addition, stable processing wherein no substances adhere on the surface of the light-sensitive material processed become possible.

In addition, since the moisture in air separating device (a dehumidifier) is provided, air near the automatic processing machine is dehumidified and dried. Therefore, wetting of the solid processing agent housed in the solid processing agent supplying means due to humidity, deformation, specifically deterioration of the processing components can markedly be inhibited. In addition, a problem that the solid processing agent closing each other is stacked due to humidity so that a prescribed amount is not charged in charging even when the tablet is divided and weighed to a prescribed amount in advance or the tablet is clogged at the supplying port resulting in that no tablet is supplied can be prevented.

As the moisture in air separating device, a commercially available dehumidifier can be used. In addition, by means of a heat pump or an electronic chilling element, specifically, a Peltier element, a device to coagulate air or a device structured by a system of coagulating air can be used. In addition, a device or a system to separate moisture by means of a semi-permeating membrane which separates vapor from air can also be used. In addition, the above-mentioned devices and systems can be combined to be used.

With regard to the timing of the operation of the moisture in air separating device, when the vicinity of the automatic processing machine or the above the processing tank and the drying portion come to have high humidity, i.e., when the automatic processing machine is being operated, water can be obtained most efficiently. Therefore, it is preferable that the moisture in air separating device is operated integrally with the operation of the automatic processing machine, and it is possible to control the moisture in air separating device. Even when the automatic processing machine is not operated, in the case that humidity in the vicinity of the automatic processing machine is constantly high, it is preferable to constantly control and operate the moisture in air separating device. Specifically, in the above-mentioned system, it is preferable to sense humidity inside the solid processing agent supplying device, and then, to control and operate the moisture in air separating device in a manner that constantly low humidity can be kept.

It is also preferable to provide a filter member at air absorption portion of the moisture in the moisture in air separating device. By means of it, mixture of dust and mickle which floats in the air into a stored water, showing a desirable anti-mildew effect. Therefore, a problem that stored water wherein a bleaching processing component is supplied to a color developing solution, causing adverse effect on photographic performances can be prevented.

By providing the moisture in air separating device and the automatic processing machine separately wherein the moisture in air separating device and a developing solution housing tank are communicated only by means of an introduction means of water, i.e., water feeding pipe, which was generated by the moisture in air separating device, the effect of such an apparatus can be obtained not by complexing and extending the automatic processing machine. In addition, the moisture in air separating device can be placed freely in a place where dehumidifying effects are favorable not considering the place of the automatic processing machine.

By providing the moisture in air separating device in a manner that it absorbs the gas of the drying unit of the automatic processing machine, the moisture in air separating device can inhale high humidity air during the operation of the automatic processing machine so that water can be obtained effectively. In addition, emitting of high humidity air to the automatic processing machine can be prevented so that storage stability can be improved by keeping in the vicinity of the solid processing agent at low humidity.

By structuring the moisture in air separating device in a manner that it inhales the air above the processing tank of the automatic processing machine, the same effects as when it is structured in the air in the above-mentioned drying unit in inhaled.

When the moisture in air separating device is provided in a manner that it inhales air in the drying unit of the automatic processing machine, preferable effects can be obtained when the temperature of the air inhaled by the moisture in air separating device is controlled, i.e., reduced, to 50° C. or less compared to when the high temperature (the drying temperature is 50° to 70° C.) air is inhaled since the dehumidifying efficiency of the moisture in air separating device per operating energy is improved and the effects of drying and water absorption is improved.

When the moisture in air separating device is provided in a manner that dry air generated by the moisture in air separating device is introduced to the drying unit of the automatic processing machine, specifically, when a heat pump or an electronic chilling element is used as the moisture in air separating device, the temperature of the above-mentioned dry air is lower than the air inside the drying unit. Therefore, when the air is introduced as it is, even when the moisture amount inside the drying unit can be reduced, poor drying of the light-sensitive material occurs due to the reduction of an temperature instantly occurs. As a result, dirt occurs on the light-sensitive material. By controlling the temperature before introducing the above-mentioned air into the drying unit, in other words, by increasing the air temperature to close to the drying temperature in the automatic processing machine, poor drying of the light-sensitive material can be inhibited so that a desirable effects can be resulted.

By exchanging heat between the air inhaled to the moisture in air separating device and the air emitted from the moisture in air separating device, it is so preferable that load of the temperature controlling mechanism can be lightened.

The moisture in air separating device inhales and emits air. Due to this, air flow necessarily occurs. By controlling this air flow by means of an air feeding tube, moisture can be occurred in the vicinity of the supplying port of the solid processing agent into the automatic processing machine. Due to this, the occurrence of mildew concentration at the above-mentioned supplying port of vapor which occurs due to the processing solution inside the processing tank whose temperature is adjusted can be inhibited. As a result, a problem in which the solid processing agent adheres on the supplying port so that defective supplying is caused can be prevented and desirable effects can be obtained.

By providing the moisture in air separating device above the replenishing water tank, the resulting water can be fed to the replenishing water tank not using an in-feed means such as a pump. In addition, dehumidifying of vapor which occurs from the automatic processing machine and remains above can be conducted so that effective drying and water feeding can be desirably conducted.

The twenty-sixth embodiment is specifically useful when the automatic processing machine for the silver halide photographic light-sensitive material described in either embodiment 1 through 25 above, wherein the silver halide photographic light-sensitive material is a silver halide color photographic light-sensitive material, the developing solution is a color developing solution, photographic processing is a color photographic processing and a developing tank is a color developing tank.

The twenty-seventh embodiment is that, even due to the automatic processing machine for the silver halide photographic light-sensitive material described in either embodiment 1 through 25 above, wherein a bleaching solution, a fixing solution or a bleach-fixing solution is used in place of the developing solution, corresponding thereto, bleaching processing, fixing processing or bleach fixing processing are used in place of the developing processing and a bleaching processing tank, a fixing processing tank or a bleach-fixing processing tank is used in place of the developing tank, deterioration due to oxidation of a bleaching processing agent, a fixing processing agent or a bleach-fixing processing agent can be prevented so that it is preferable.

DETAILED EXPLANATION OF THE INVENTION

A solid processing agent of the present invention is a processing agent for replenishing a processing agent component of a processing solution, and made of solid. For the solid processing agent, powder, tablet, pill and granule are cited. In addition, as necessary, those provided with a water-soluble polymer on their surface may be allowed. "Powder" in the present invention is referred to as aggregate of fine-crystal. "Granule" in the present invention is referred to as granulated powder. It is preferable to be granule whose grain size is 50 to 500 μm. "Tablet" in the present invention is referred to as a material wherein powder or granule are compressed and molded to tablet to a certain form. "Pill" in the present invention is referred to as a round material (including potato and a sphere) due to granulation or tableting. Of the above-mentioned solid processing agents, either of granule, tablet or pill is preferable because the occurrence of powder dust in handling is small and charging accuracy is better. Of these, tablet is preferable because it has high replenishing accuracy and a simple handling. In addition, it is abruptly dissolved so that density is not varried rapidly. Therefore, the effect of the present invention can be provided preferably.

For solifidying a photographic processing agent, arbitrary means can be adopted such as to knead a condensed solution or fine powder or photographic processing agent and to mold and to form a laminated layer by spraying a water-soluble binders on the surface of a photographic processing agent temporarily molded (see Japanese Patent O.P.I. Publication Nos. 29136/1992, 85533/1992 through 85536/1992 and 172341/1992).

The preferable manufacturing method of a tablet is to form a tablet by tableting after granulating powder solid processing agent. It has a merit, compared to a solid processing agent wherein a solid processing agent components are simply mied and tableted, that dissolvability and storage stability are improved. Granulating methods for forming a table, granule and a pill include conventional methods such as a rotation granulating method, an extrusion granulating method, a compression granulating method, a crushing granulating method, a stirring granulating method, a fluidized bed granulating method and a spraying and drying granulating method. In granulating, it is desirable to add 0.01 to 20 weight % of a water-soluble binder in order to provide the effects of the present invention more preferably. As a water-soluble binder, celluloses, dextrines, sugar alcohols, polyethylene glycohols and cyclodextrines are preferable.

Next, in forming a tablet by pressing the resulting granules, conventional compressors such as a oil-pressurer, a single-punch tableter, a rotary tableter and a pricketing machine can be used. In addition, when granulating, the above-mentioned effects can be provided more preferably by adding an alkaline agent and a preserver separately.

Tablet processing agents can be produced by a conventional method described in Japanese Patent O.P.I. Publication Nos. 61837/1976, 155038/1979 and 88025/1977 and British Patent No. 1,213,808. In addition, granule processing agents can be produced by a conventional method described in Japanese Patent O.P.I. Publication Nos. 109042/1990, 109043/1990, 39735/1991 and 39739/1991. In addition, powder processing agents can be produced by a conventional method described in Japanese Patent O.P.I. Publication Nos. 133332/1979 and British Patent Nos. 725,892 and 729,862 and German Patent No. 3,733,861.

As a means for supplying the solid processing agent in the present invention, conventional methods such as, when the solid processing agent is a tablet, Japanese Utility Publication Open to Public Inspection Nos. 137783/1988, 97522/1988 and 85732/1989 are cited. In other words, any methods can be used as long as that a function to supply the tablet to the processing tank is provided. When the solid processing agent is either granule or powder, methods by the use of a gravity dropping method such as those described in Japanese Utility Publication Open to Public Inspection Nos. 81964/1987 and 84151/1988 and Japanese Patent O.P.I. Publication No. 292375/1989 and methods by the use of a screw or a tap scres such as those described in Japanese Utility Publication Open to Public Inspection Nos. 105159/1988 and 195345/1988. However, the present invention is not limited thereto.

Any place is allowed for supplying the solid processing agent of the present invention. However, the preferable place is a circulation route which communicates with a processing tank where the light-sensitive material is processed and in which the processing solution is circulated between the processing tank. It is preferable that the solid processing agent is supplied into the processing solution whose temperature is regulated.

Amount of the solid processing agent is, from the viewpoint of the effects of the present invention, durability of the charging device and the accuracy in one charging, preferable to be 0.1 g or more, and from the viewpoint of the effects of the present invention and dissolution time, it is preferable to be 50 g or less.

When the added amount of replenisher is 30 ml or more per 1 $m^2$ of light-sensitive material, reduction of liquid surface of the processing solution is difficult to occur in the processing tank of the automatic processing machine, necessary processing time can be obtained, photographic performance is not adversely influenced and coagulation of crystal due to the accumulation of unnecessary componens in the processing solution and the occurrence of stain and dirt are scarcely caused. In addition, when the added amount of the above-mentioned replenisher water is 75 ml/$m^2$ or less, compared to cases when a conventional replenishing system is used, the amount of replenisher water and effluent are reduced, contributing to the prevention of pollution. Added amount of replenishing water is preferably 35 ml/$m^2$ or more (specifically, 40 ml/$m^2$ or more) and 70 ml/$m^2$ or less (specifically, 60 ml/$m^2$).

In this occasion, it is preferable that the replenishing amount of the developing agent occupying in the solid processing agent supplied is 0.024 mol/liter to 0.066 mol/liter, in terms of ratio to the supplied amount of the above-mentioned replenishing water. It is more preferably 0.028 mol/liter to 0.062 mol/liter, and specifically preferably 0.033 mol/liter to 0.048 mol/liter. Namely, when the above-mentioned ratio is larger than the lower limit of the above-mentioned range, the supply amount of replenishing water and the amount of effluent can substantially be reduced while sufficient photographic density are obtained. In addition, when the above-mentioned ratio is smaller than the upper limit of the above-mentioned range, the density of the processing agent cannot be too high. A problem in that the dissolubability of the above-mentioned paraphenylene diamine color developer is brought to close to the limit so that crystals are coagulated and precipitants occurs is not difficult to occur.

As a color developing agent, p-phenylene diamine compounds having a water-soluble group are preferable. As the above-mentioned water-soluble group, an amino group or a benzene group on which there is at least one p-phenylene diamine compounds. Practical water-soluble groups are $-(CH_2)_n-CH_2OH$, $-(CH_2)_m-NHSO_2-(CH_2)_nCH_3$, $-(CH_2)_m-O-(CH_2)_n-CH_3$, $-(CH_2CH_2O)_nC_mH_{2m+1}$ (wherein m and n represent 0 or more integers), —COOH group and $-SO_3H$ group.

As practically illustrated compounds of the color developing agent preferably used, the following compounds (C-1) through (C-18) are cited.

[Illustrated color developing agents]

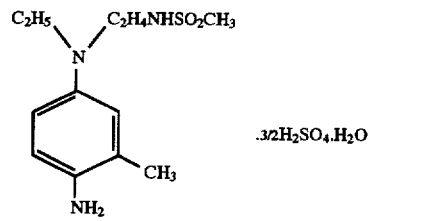

(C-1)

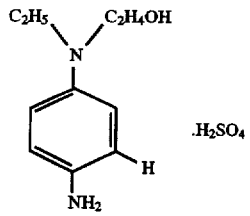

(C-2)

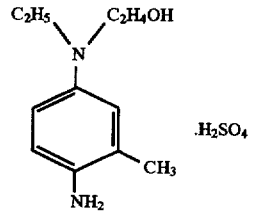

(C-3)

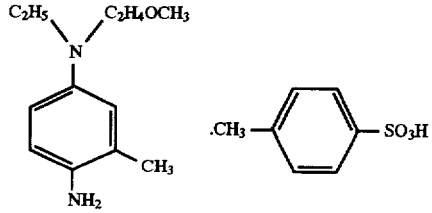

(C-4)

-continued
[Illustrated color developing agents]
(C-5)
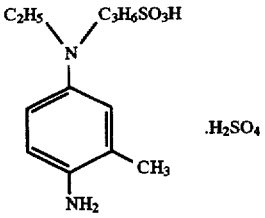
(C-6)
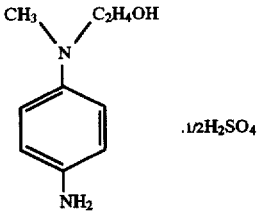
(C-7)
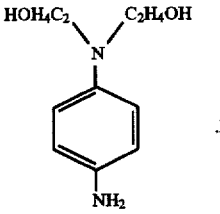
(C-8)
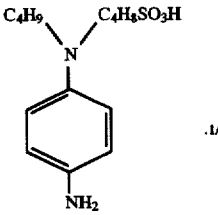
(C-9)
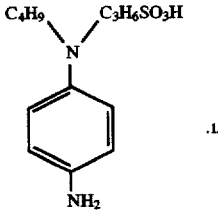
(C-10)
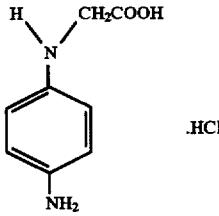
(C-11)
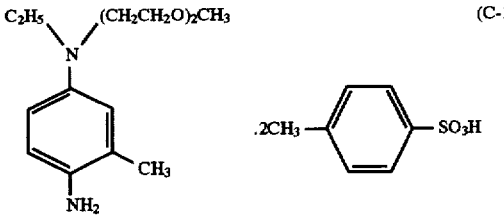
-continued
[Illustrated color developing agents]
(C-12)
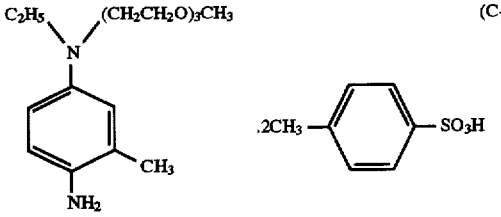
(C-13)
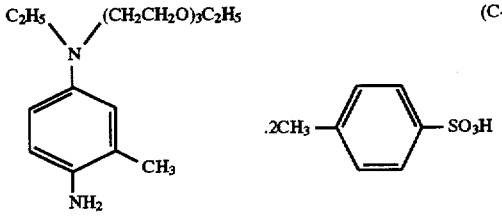
(C-14)
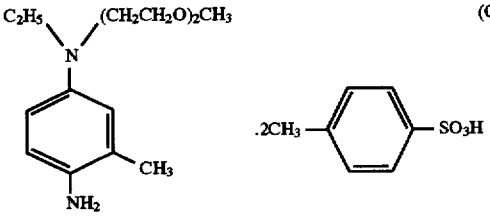
(C-15)
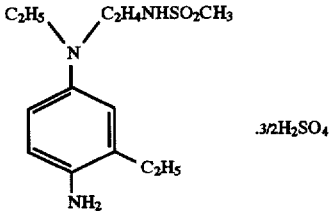
(C-16)
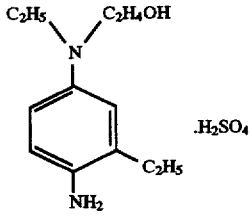
(C-17)
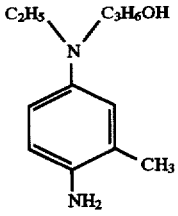
(C-18)
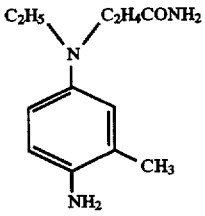
Of the above-mentioned compounds, the preferable are those represented by (C-1), (C-2), (C-3), (C-4), (C-15), (C-17) and (C-18).

The preferable color developing agents are paraphenylenediamine color developing agents having a water-soluble group represented by the following Formula [I].

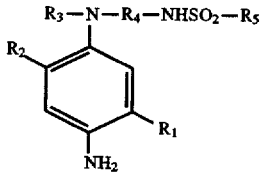

Formula [I]

wherein $R_1$ and $R_2$ independently represent a hydrogen atom, a halogen, an alkyl group, an alkoxy group or an acylamino group; $R_3$ represents an alkyl group; $R_4$ represents an alkylene group; and R5 represents a substituted or unsubstituted alkyl group or aryl group.

As practical illustrated compounds thereof, other than the above-mentioned compounds, compounds (C-19) through (C-35) are cited. These compounds are shown by compounds $R_1$ through $R_5$ represented by Formula [I].

| | $R_1$ | $R_2$ | $R_3$ | $R_4$ | $R_5$ |
|---|---|---|---|---|---|
| C-19 | —H | —H | $—C_3H_7$ | $—CH_2CH(—CH_3)—$ | $—CH_3$ |
| C-20 | $—NHCOCH_3$ | —H | $—CH_3$ | $—CH_2CH_2—$ | $—CH_3$ |
| C-21 | —H | —H | $—CH_3$ | $—CH_2CH(—CH_3)—$ | $—CH_3$ |
| C-22 | $—CH_2CH_3$ | —H | $—CH_3$ | $—CH_2CH_2—$ | $—CH_3$ |
| C-23 | $—CH_3$ | —H | $—CH_3$ | $—CH_2CH(—CH_3)—$ | $—CH_2CH_3$ |
| C-24 | $—CH_3$ | —H | $—CH_3$ | $—CH_2CH_2—$ | $—CH_2CH_3$ |
| C-25 | $—O—CH_2CH_3$ | —H | $—CH_2CH_3$ | $—CH(—CH_3)CH_2—$ | $—CH_3$ |
| C-26 | $—NHCOCH_3$ | —H | $—C_3H_7$ | $—CH_2CH_2—$ | $—CH_3$ |
| C-27 | $—CH_3$ | —H | $—CH_2CH_3$ | $—CH_2CH_2—$ | $—CH_2—O—CH_3$ |
| C-28 | —H | —H | $—CH_3$ | $—CH_2CH_2—$ | $—CH_2—N—(CH_3)_2$ |
| C-29 | $—CH_3$ | —H | $—CH_2CH_3$ | $—CH_2CH_2—$ | $—CH_2Cl$ |
| C-30 | $—CH_3$ | —H | $—CH_2CH_3$ | $—CH_2CH_2—$ | $CH_2—NHCO—CH_3$ |
| C-31 | $—CH_2CH_3$ | —H | $—CH_2CH_3$ | $—CH_2CH_2—$ | $—CH_2—O—CH_3$ |
| C-32 | $—CH_3$ | —H | $—CH_2CH_3$ | $—CH_2CH_2—$ | $—CH_2—O—CH_2CH_3$ |
| C-33 | $—CH_3$ | —H | $—CH_2CH_3$ | $—CH_2CH_2CH_2—$ | $—CH_3$ |
| C-34 | —Cl | —H | $—CH_3$ | $—CH_2CH_2CH_2—$ | $—CH_3$ |
| C-35 | $—O—CH_3$ | —H | $—CH_2CH_3$ | $—CH_2CH(—CH_3)—$ | $—CH_3$ |

Of the above-mentioned illustrated compounds, the preferable ones are (C-20), (C-27), (C-29), (C-30) and (C-33). The most preferable of the all of the above-mentioned illustrated compounds is (C-1). Compounds of Formula [I] can be practically synthesized in accordance with a method described in Japanese Patent O.P.I. Publication No. 37198/1992. The above-mentioned color developing agents are used in a form of hydrochlorate, sulfate and p-toluene sulfonic acid salt.

The above-mentioned color developing agents can be used independently or two or more thereof can be used in combination. In addition, if desired, a black-and-white developing agent such as phenidone, 4-hydroxymethyl-4-methyl-1-phenyl-3-pyrazolidone and methol can be used in combination with the above-mentioned agents.

In addition, it is preferable to incorporate compounds represented by the following Formula [A] or [B] in a color developing agent. Namely, when a processing agent is solidified, storage stability of the solid processing agent such as a tablet is improved compared to other compounds. In addition, there is another merit in that a light-sensitive material is more stable in terms of photographic performance and fogging which occurs on an unexposed portions is small.

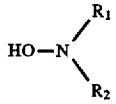

Formula [A]

In Formula [A], $R_1$ and $R_2$ independently represent an alkyl group, an aryl group, an R', a —CO— group or a hydrogen atom, provided that both are not hydrogen atoms concurrently. An alkyl group represented by $R_1$ and $R_2$ may be the same or different. They are preferably alkyl groups having 1 to 3 carbons. The above-mentioned alkyl group may have a carboxylic acid group, a phosphoric acid group, a sulfonic acid group or a hydroxylic acid group. R' represents an alkoxy group, an alkyl group or an aryl group. The alkyl group and the aryl group in $R_1$ and $R_2$ contain those including a substituent. $R_1$ and $R_2$ may be linked together for forming a ring including a heterocycle such as pyperidine, pyridine, triazine and morphorine.

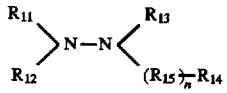

Formula [B]

In Formula [B], $R_{11}$, $R_{12}$ and $R_{13}$ independently represent a hydrogen atom, a substitued or unsubstituted alkyl group, aryl group or heterocycle. $R_{14}$ represents a hydroxy group, a hydroxyamino group, a substituted or unsubstituted alkyl group, aryl group, heterocycle, alkoxy group, aryloxy group, carbamoyl group and amino group. A heterocyclic group includes a 5- or 6-membered ring composed of C, H, O, N, S and a halogen atom. They may be saturated or unsaturated. $R_{15}$ represents a divalent group selected from —CO—, $—SO_2—$ or —C(=NH)—. n represents 0 or 1. When n is 0 specifically, $R_{14}$ represents an alkyl group, an aryl group and groups selected from a heterocycle. $R_{13}$ and $R_{14}$ may form a heterocycle in combination.

Of the compounds represented by Formula [A], compounds represented by the following Formula [2] are specifically preferable since they provide the effects of the present invention more prominently.

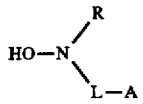

Formula [2]

wherein L represents an alkylene group; A represents a carboxyl group, a sulfo group, a phosphono group, a phosphinic acid group, a hydroxyl group, an amino group, an ammonio group, a carbamoyl group or a sulfamoyl group; R represents a hydrogen atom or an alkyl group; each of L, A and R may include a straight-chained and a branched-chained and may be unsubstituted or substituted; and L and R may be linked together for forming a ring.

Compounds represented by Formula [2] will be explained in detail. In the Formula, L represents a straight or branched alkylene group, which may be substituted, having 1 to 10 carbons. The carbon number is preferably 1 through 5. Practically, methylene, ethylene, trimethylene and propylene are cited as preferable examples. As a substituent, a carboxyl group, a sulfon group, a phosphono group, a phosphine group, a hydroxyl group and an ammonio group which may be subjected to alkyl substituting. The preferable examples are a carboxyl group, a sulfo group, a phosphono group and a hydroxyl group. As A, a carboxyl group, a sulfo group, a phosphono group, a phosphinic acid group, a hydroxyl group, an amino group which may be subjected to alkyl substituting, an ammonio group, a carbamoyl group or a sulfamoyl group are cited, and a carboxyl group, a sulfo group, a hydroxyl group, a phosphono group and a carbamoyl group which may be subjected to alkyl substituting are preferably cited. As an example of -L-A, a carboxylmethyl group, a carboxylethyl group, a carboxylpropyl group, a sulfoethyl group, a sulfopropyl group, a sulfobutyl group, a phosphonomethyl group, a phosphonoethyl group and a hydroxyethyl group are preferably cited. Of these, a carboxylmethyl group, a carboxylethyl group, a sulfoethyl group, a sulfopropyl group, a phosphonomethyl group and a phosphonoethyl group are more preferably cited. R represents a hydrogen atom and a straight or branched-chained alkyl group, which may be substituted, having 1 through 10 carbon atoms. The number of carbon atom is preferably 1 through 5. As a substituent, a carboxyl group, a sulfo group, a phosphono group, a phosphinic acid group, a hydroxyl group, an amino group which may be subjected to alkyl substituent, an ammonio group, a carbamoyl group or a sulfamoyl group are cited. The number of substituent may be two or more. As an R, a hydrogen atom, a carboxymethyl group, a carboxyethyl group, a carboxypropyl group, a sulfoethyl groupa sulfopropyl group, a sulfobutyl group, a phosphonomethyl group, a phosphonoethyl group and a hydroxyethyl group are cited as preferable examples. Of these, a hydrogen atom, a carboxymethyl group, a carboxyethyl group, a sulfoethyl groupa sulfopropyl group, a phosphonomethyl group and a phosphonoethyl group are cited as more preferable examples. L and R may be linked together for forming a ring.

Of the compounds represented by Formula [2], typical ones are illustrated below.

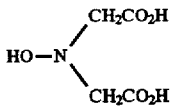

D-(1)

-continued

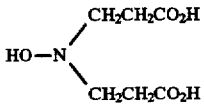

D-(2)

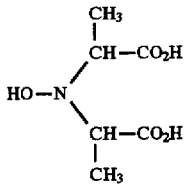

D-(3)

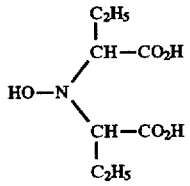

D-(4)

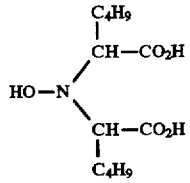

D-(5)

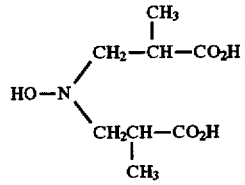

D-(6)

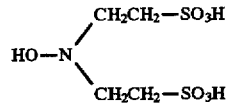

D-(7)

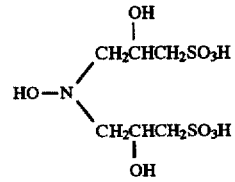

D-(8)

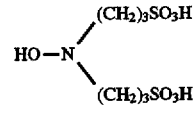

D-(9)

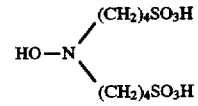

D-(10)

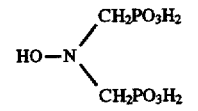

D-(11)

-continued
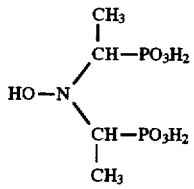
D-(12)
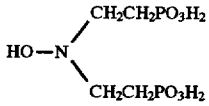
D-(13)
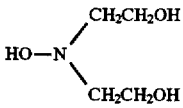
D-(14)
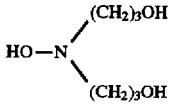
D-(15)
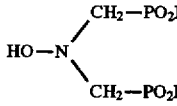
D-(16)
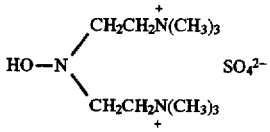
D(17)
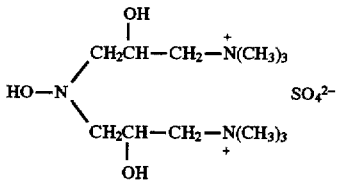
D(18)
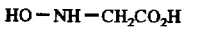
D-(19)
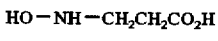
D-(20)
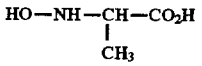
D-(21)
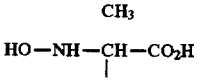
D-(22)
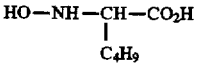
D-(23)
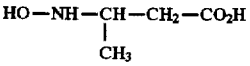
D-(24)
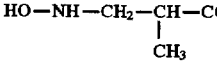
D-(25)
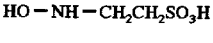
D-(26)
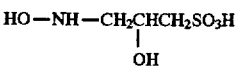
D-(27)
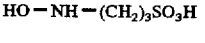
D-(28)
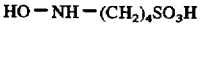
D-(29)
-continued
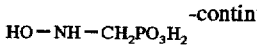
D-(30)
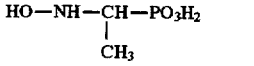
D-(31)
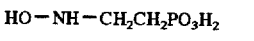
D-(32)
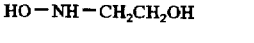
D-(33)
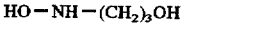
D-(34)
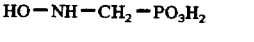
D-(35)
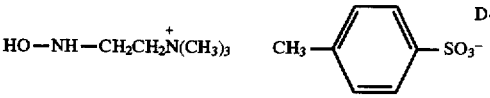
D-(36)
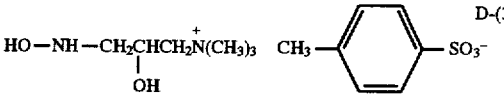
D-(37)
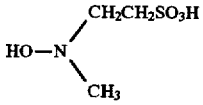
D-(38)
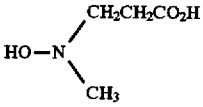
D-(39)
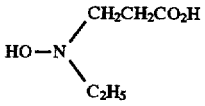
D-(40)
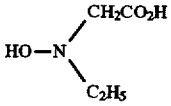
D-(41)
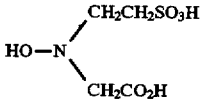
D-(42)
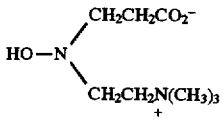
D-(43)
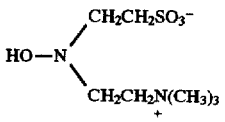
D-(44)
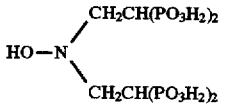
D-(45)
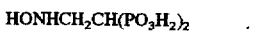
D-(46)
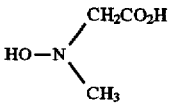
D-(47)

-continued

D-(48)

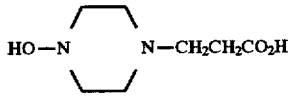

D-(49)

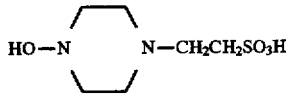

D-(50)

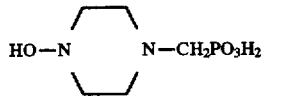

D-(51)

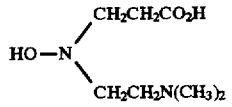

D-(52)

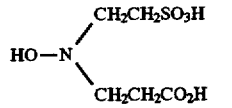

D-(53)

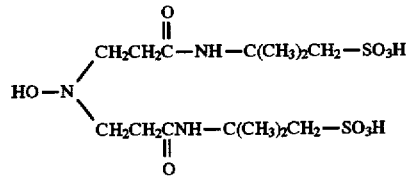

D-(54)

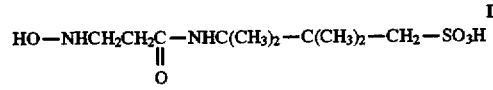

D-(55)

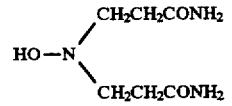

salts, p-aminophenols, amine compounds, polyalkyleneoxide, 1-phenyl-3-pyrazolidones, hydrozines, mesoion type compounds, ion type compounds and imidazoles may be added as needed.

It is preferable that the color developer and the color developing agent do not contain substantial amount of benzyl alcohol.

For the purpose of preventing fogging, chlorine ion and bromine ions may be added in a color developing solution in a processing tank. When they are directly added to the color developer, as a chlorine ion supplying substance, chlorinated substances of sodium, potassium, ammonium, nickel, magnesium, manganese, calcium or cadimium are cited. Of these, the preferable ones are sodium chloride and potassium chloride. In addition, they may be added in the form of a corresponding salt to a fluorescent brightening agent. As a supplying material of bromine ion, brominated products of sodium, potassium, ammonium, lithium, calsium, magnesium, manganese, nickel, cadmium, selium or thalium are cited. Of these, the preferable ones are potassium bromide and sodium bromide.

It is preferable to add a triazinyl stylbene fluorescent brightening agent to a color developing agent of the present invention from the viewpoint of the effects of the present invention. As such a fluorescent brightening agent, compounds represented by the following Formula [E] are preferable.

Formula [E]

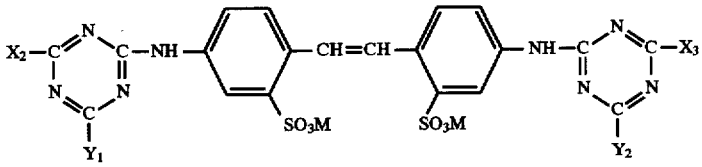

The compounds represented by the above-mentioned Formula [A] or [B] are ordinarily used in a form of isolated amine, hydrochlorate, sulfate, p-toluene sulfonic acid salt, borate, phosphoric acid salt and acetate.

In a color developing agent, small amount of sulfite salt may be used as a preserver. As aforesaid sulfite salt, sodium sulfite, potassium sulfite, sodium bisulfite and potassium bisulfite are cited.

In the color developing agent, a buffer agent may be used. As the buffer agent, potassium carbonate, sodium carbonate, sodium bicarbonate, potassium bicarbonate, trisodiumphosphate, trisodium phosphate, disodiumphosphate, sodium borate, potassium borate, sodium tetraborate (borate), potassium tetraborate, sodium o-hydroxybenzoate (sodium saltylic acid), potassium o-hydroxybenzoate, sodium 5-sulfo-2-hydroxybenzoate (sodium 5-sulfosaltylic acid) and potassium 5-sulfo-2-hydroxybenzoate (potassium 5-sulfosaltylic acid) are preferable.

As a development accelerator, thioether compounds, p-phenylenediamine compounds, quarternary ammonium wherein $X_2$, $X_3$, $Y_1$ and $Y_2$ independently represent a hydroxide group, a halogen atom such as chlorine or bromine, an alkyl group, an aryl group,

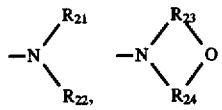

or —$OR_{25}$; $R_{21}$ and $R_{22}$ independently represent a hydrogen atom, an alkyl group (including substituents) or an aryl group (including substituents); $R_{25}$ represents a hydrogen atom, an alkyl group (including substituents) or an aryl group (including substituents); and M represents a cation.

In addition, various additives such as an anti-staining agent, an anti-sludge agent and multi-layer effect promoting agents may be used.

It is preferable to add chelating agents represented by the following Formulas [K-I] through [K-V] to the color developing agent and to the black-and-white developing agent from viewpoint of attaining the objects of the present invention.
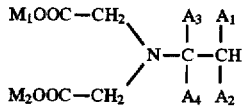
Formula [K-I]
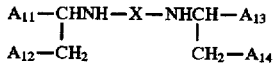
Formula [K-II]
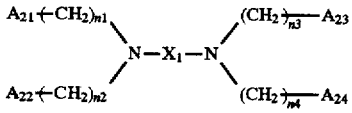
Formula [K-III]
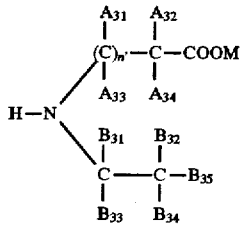
Formula [K-IV]
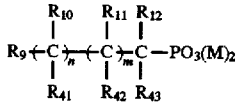
Formula [K-V]
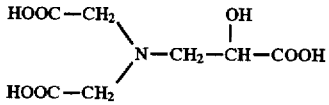
K-I-1
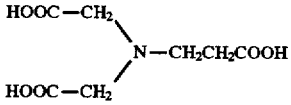
K-I-2
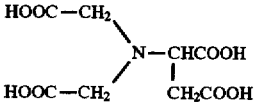
K-I-3
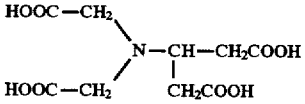
K-I-4
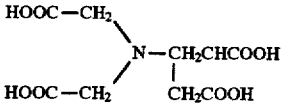
K-I-5
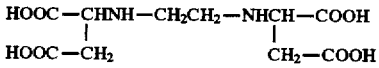
K-II-1
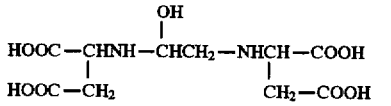
K-II-2
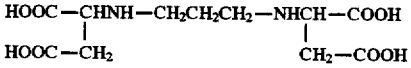
K-II-3
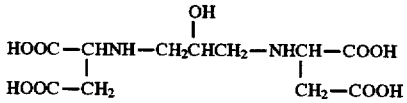
K-II-4
-continued
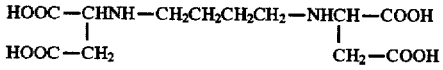
K-II-5
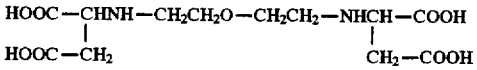
K-II-6
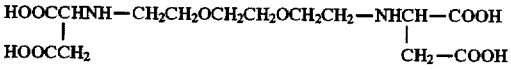
K-II-7
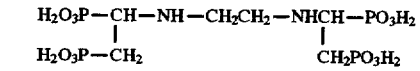
K-II-8
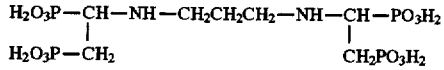
K-II-9
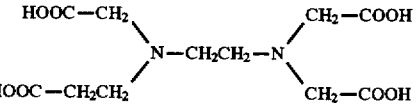
K-III-1
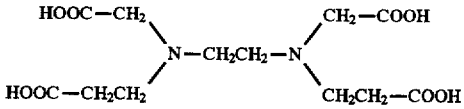
K-III-2
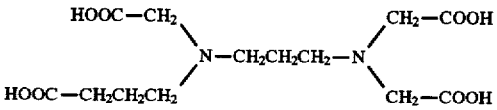
K-III-3
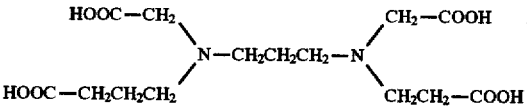
K-III-4
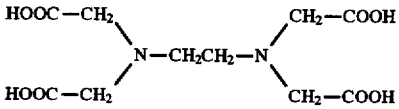
K-III-5
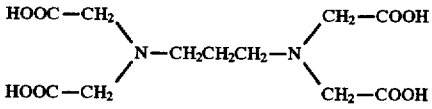
K-III-6
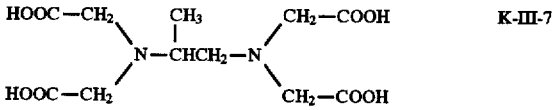
K-III-7
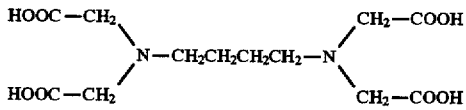
K-III-8
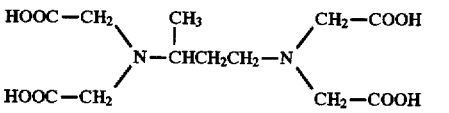
K-III-9
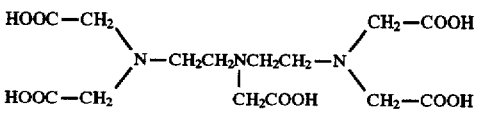
K-III-10

-continued

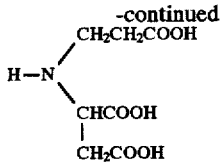

K-IV-1

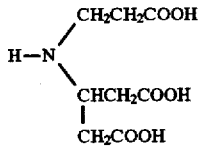

K-IV-2

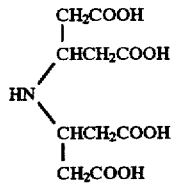

K-IV-3

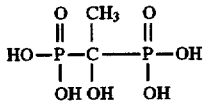

K-V-1

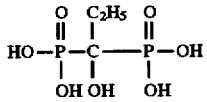

K-V-2

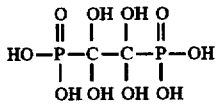

K-V-3

Of the above-mentioned chelating agents, K-I-2, K-II-1, K-II-5, K-III-10, K-IV-1 and K-V-1 are preferably used. They provide the effects of the present invention favorably.

In addition, to the color developing agent, an anion, a cation, a amphoteric and a nonion surfactant may be added addition, if necessary, various surfactants such as an algilsulfonic acid, arylsulfonic acid, an aliphatic carbonic acid and an aromatic carbonic acid may be added.

With regard to the density of the color developing agent in the processing solution in the color developing tank, 0.018 mol/liter or more provides the effect of the present invention more prominently, and 0.020 mol/liter or more is still more preferable. In Examples explained later, all of those of the present invention were 0.022 mol/liter or more.

In the present invention, it is desirable that the temperature of the processing solution in the color developing tank be controlled within a prescribed range and preferable to be controlled to within ±1.5° C. (most specifically, ±0.5° C.).

A solid processing agent for color developing may be one solid processing agent containing a color developing agent, an alkaline agent and a preserver or may also be several solid processing agents wherein each agent is composed of part.

As a light-sensitive material used in the present invention, a silver halide color photographic light-sensitive material containing a silver halide emulsion wherein 80 mol % or more of the silver halide composition is composed of (specifically 90 mol % or more) silver chloride.

DETAILED DESCRIPTION OF THE PREFERRED EMBODIMENT

Hereunder, examples of the present invention will be explained. However, the present invention is not limited thereto.

(EXAMPLE 1)

Figure 1:
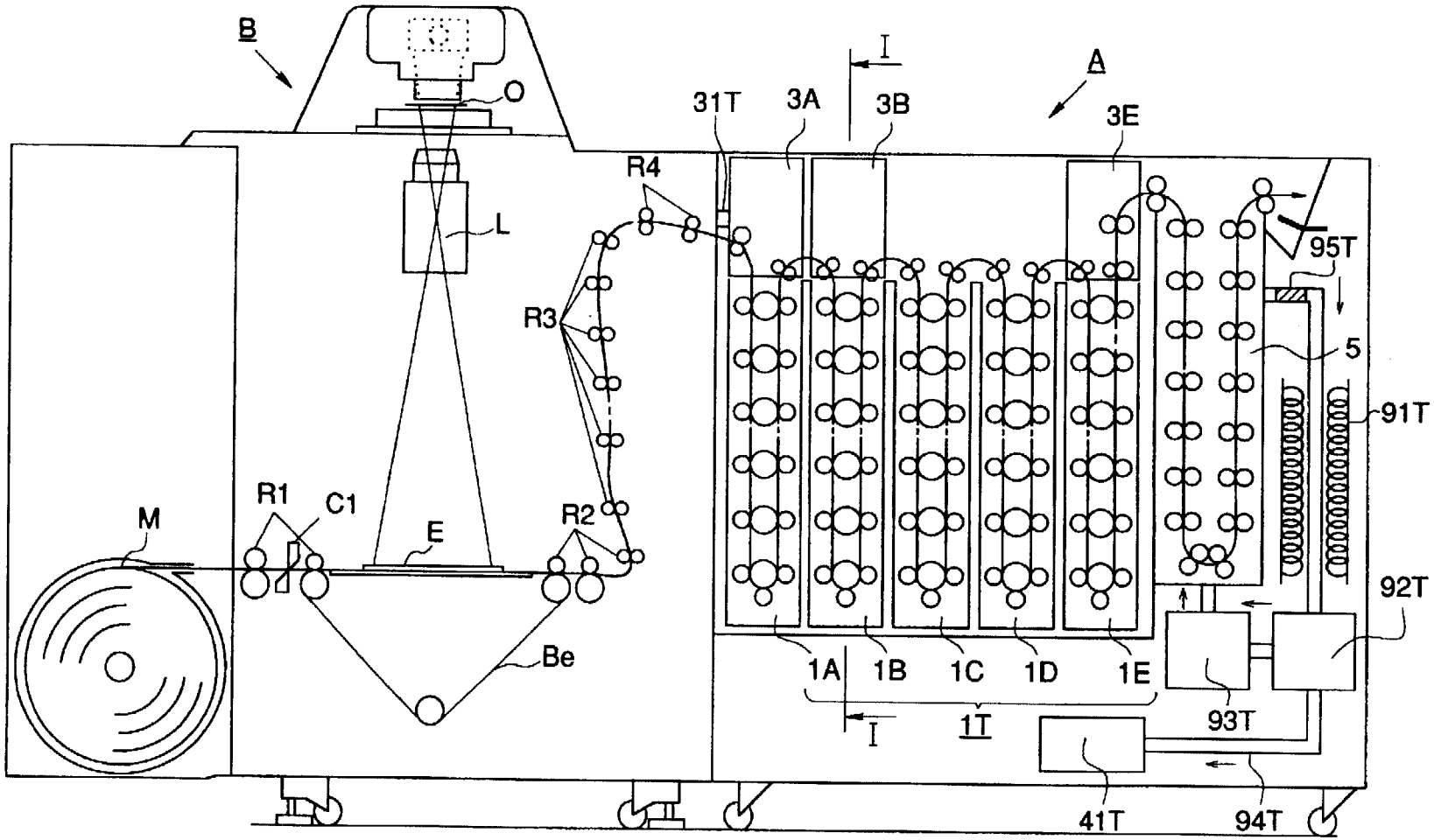
FIG. 1 is a schematic diagram of a silver halide photographic light-sensitive material processing apparatus.

An automatic processing machine which an example of an automatic processing machine applicable to the present invention will be explained referring to drawings. The automatic processing machine of the present example is an automatic processing machine wherein NPS 818, produced by Konica, is modified. FIG. 1 is a schematic block diagram of a silver halide photographic light-sensitive processing apparatus (printer processor) wherein an automatic processing machine A and a photographic printer are integrally structured.

In FIG. 1, at the lower left portion of a photographic printer B, a magazine M housing the roll of photographic paper which is an unexposed silver halide photographic light-sensitive material is set. Photographic paper fed from the magazine M is cut to a prescribed size through a feeding roller R1 and a cutter unit C1 to form sheets of photographic paper. This photographic paper is conveyed by means of a belt conveyance means Be. At an exposure unit E, an image of the original picture O is exposed by means of a lightsource and a lens L. The exposed sheet type photographic paper is conveyed by means of rollers R2, R3 and R4 which are respectively composed of pairs of rollers and introduced to the automatic processing machine A. In the automatic processing machine A, the sheet type photographic paper is conveyed through a color developing tank 1A, a bleach-fixing processing tank 1B and a stabilizing processing tank (the first stabilizing processing tank 1C, the second stabilizing processing tank 1D and the third stabilizing processing tank 1E, which is a processing tank 1T substantially composed of three tanks) which are processing tanks fed by a roller conveyance means (having no reference number) sequentially, and thereby the photographic paper is subjected to color developing processing, bleach-fixing processing and stabilizing processing. The sheet type photographic paper, subjected to each of the above-mentioned processing, is dried at the drier unit 5 and then exits outside the machine. The present invention is however not limited thereto. It can be applied to any automatic processing machine substantially composed of 4 tanks including the color developing tank, the bleaching processing tank, the fixing processing tank and the stabilizing processing tank.

Air of high temperature (about 55° to 65° C.) and high humidity emitted from the drier unit 5 is chilled, through a filter 95T, in a chilling apparatus 91T. The chilled air is dehumidified in a dehumidifier 92T. The dehumidified air is heated in a heater 93T, and then, supplied to the drier unit 5 as dry air. In this manner, dry air circulates. Water condensed in the dehumidifier 92T is supplied to replenishing water tank 41T through a water-feeding tube 94T.

Incidentally, one-dot chain line in the Figure shows the conveyance route of a silver halide photographic light-sensitive material. In addition, in this Example, the light-sensitive material can be introduced to the automatic processing machine A as a cut sheet. In the present invention, the light-sensitive material introduced to the automatic processing machine in a strips state is also allowed. In such situations, when an accumulator is provided for keeping the light-sensitive material temporarily is provided between the automatic processing machine A and the photographic printer B, processing efficiency is enhanced. In addition, it goes without saying that the automatic processing machine A may be structured integrally with a photographic printer B or may also be the automatic processing machine A as a single unit. In addition, it further goes without saying that the silver halide photographic light-sensitive material processed by the automatic processing machine A of the present invention is not limited to a photographic exposed paper. It includes also an exposed negative film.

Incidentally, the one-dot chain line in FIG. 1 shows the conveyance route of the silver halide photographic light-sensitive material. In the example, the light-sensitive material is fed to the automatic processing machine A in a cut state. Incidentally, in the present invention, the light-sensitive material may be fed to the automatic processing machine in a roll state. In this occasion, processing efficiency is improved if an accumulator which temporarily stores the light-sensitive material between the automatic processing machine A and the photographic printer B. In addition, it goes without saying that the automatic processing machine A of the present invention may be structured integrally with the photographic printer B or it may be used independently. In addition, it also goes without saying that the silver halide photographic light-sensitive material processed by the automatic processing machine of the present invention is not limited to an exposed photographic paper but includes an exposed negative film.

To each of the color developing tank A, the bleach-fixing processing tank B and the third stabilizing processing tank E, solid processing agent supplying means 3A, 3B and 3E, respectively supplying a solid processing agent, are provided.

Figure 2:
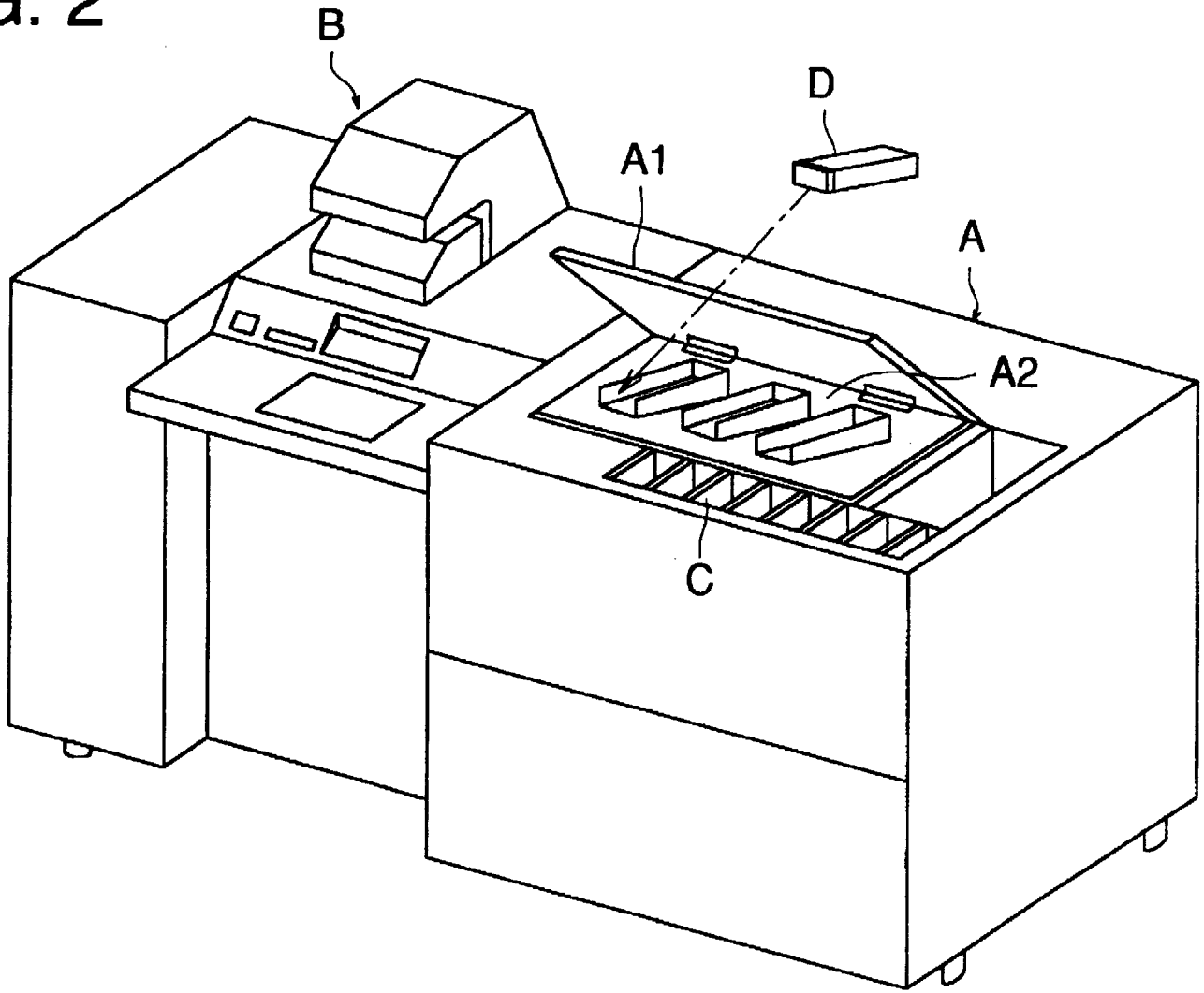
FIG. 2 is a perspective view of the above-mentioned light-sensitive processing apparatus.

FIG. 2 is a perspective view showing an overall light-sensitive processing machine wherein the automatic processing machine A and the photographic printer B of the example of the present invention is integrally joined. In this figure, a lid A1 of the automatic processing machine A is opened, and then, a housing D containing the solid processing agent is inserted from the upper left portion of the figure to the lower right portion and secured.

Figure 3:
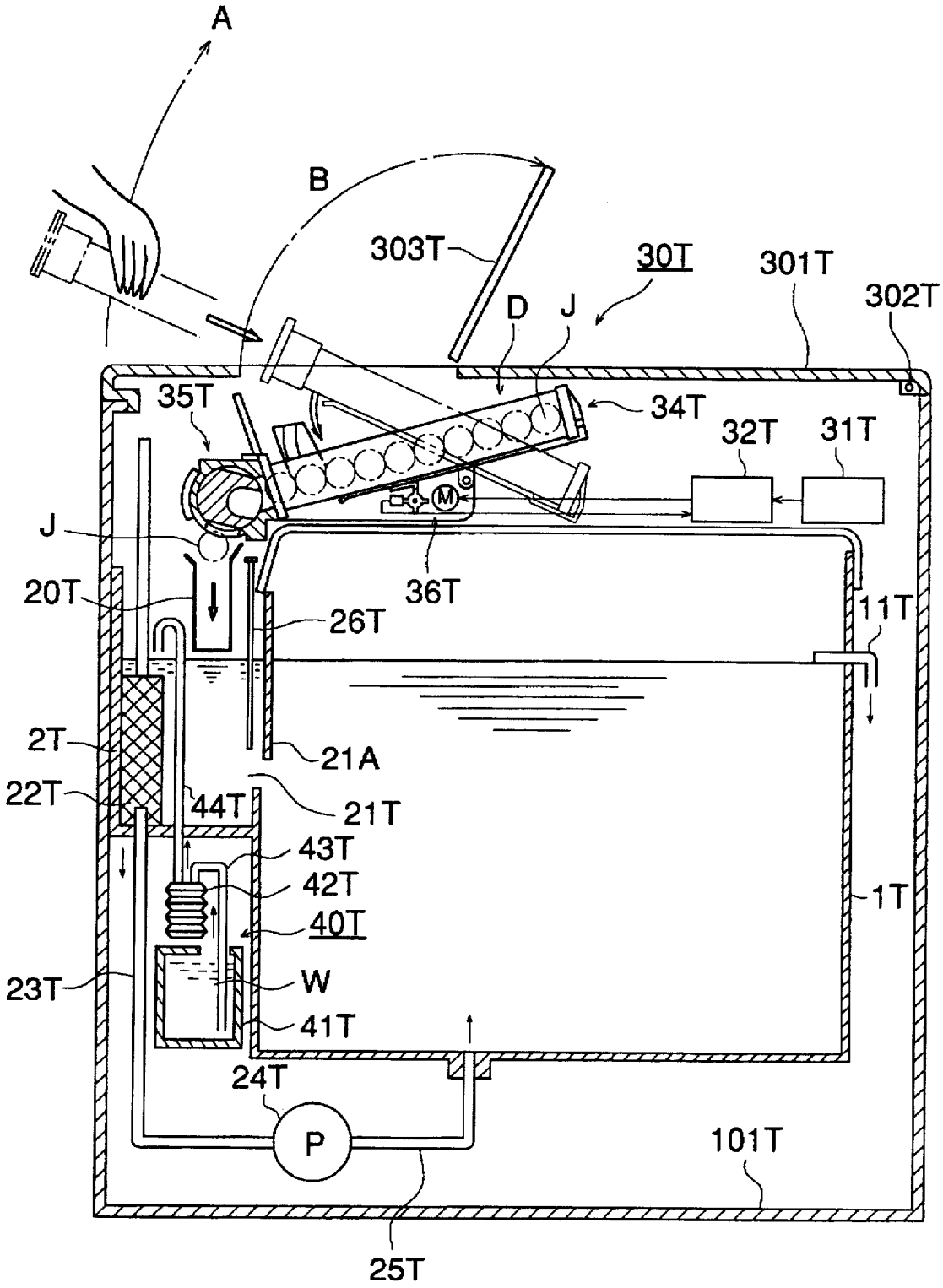
FIG. 3 is a cross-section view of the automatic processing machine of the present invention.
Figure 4:
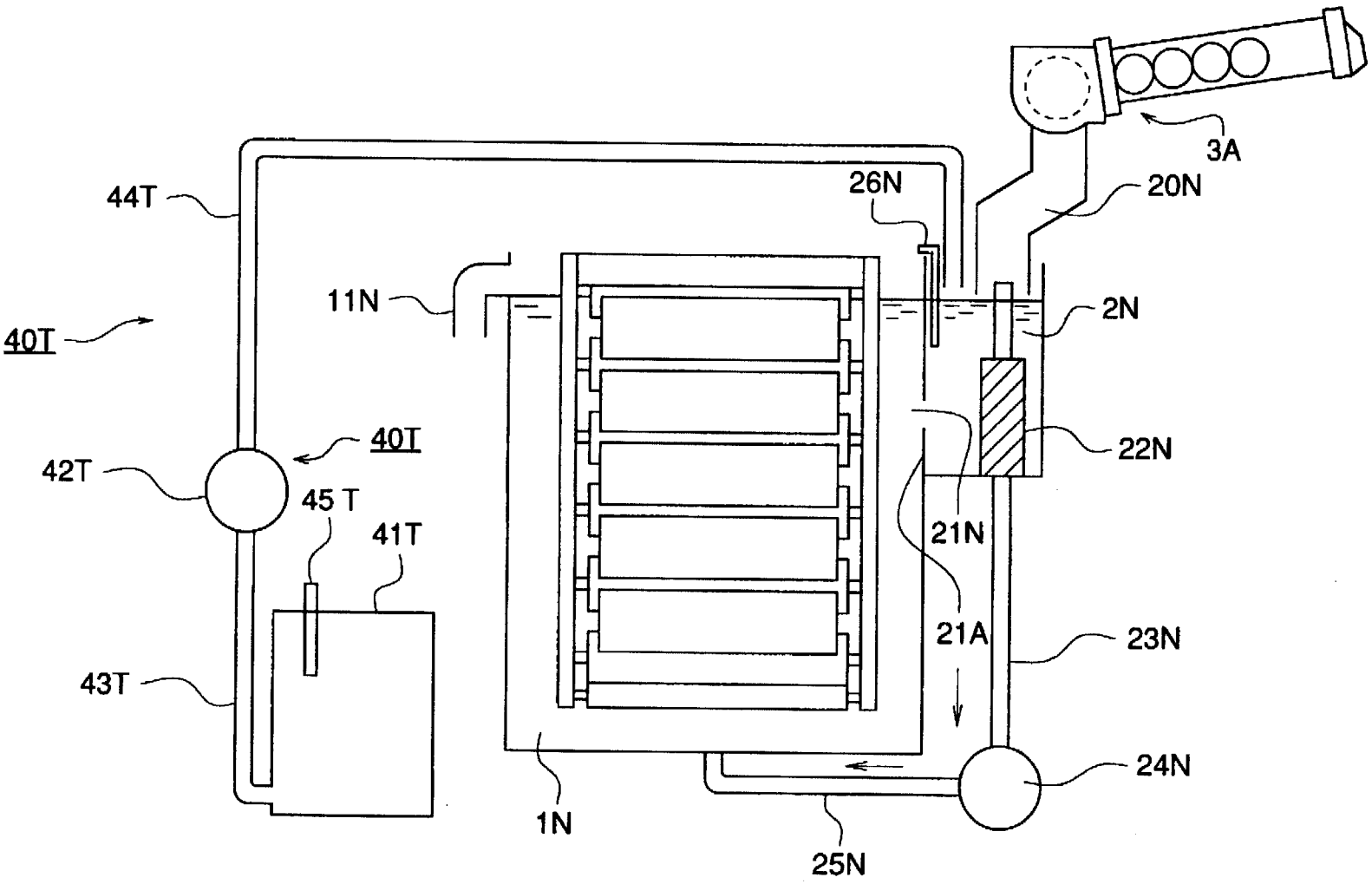
FIG. 4 is a schematic view showing a comparative example of a color developing tank of Example 1.
Figure 5:
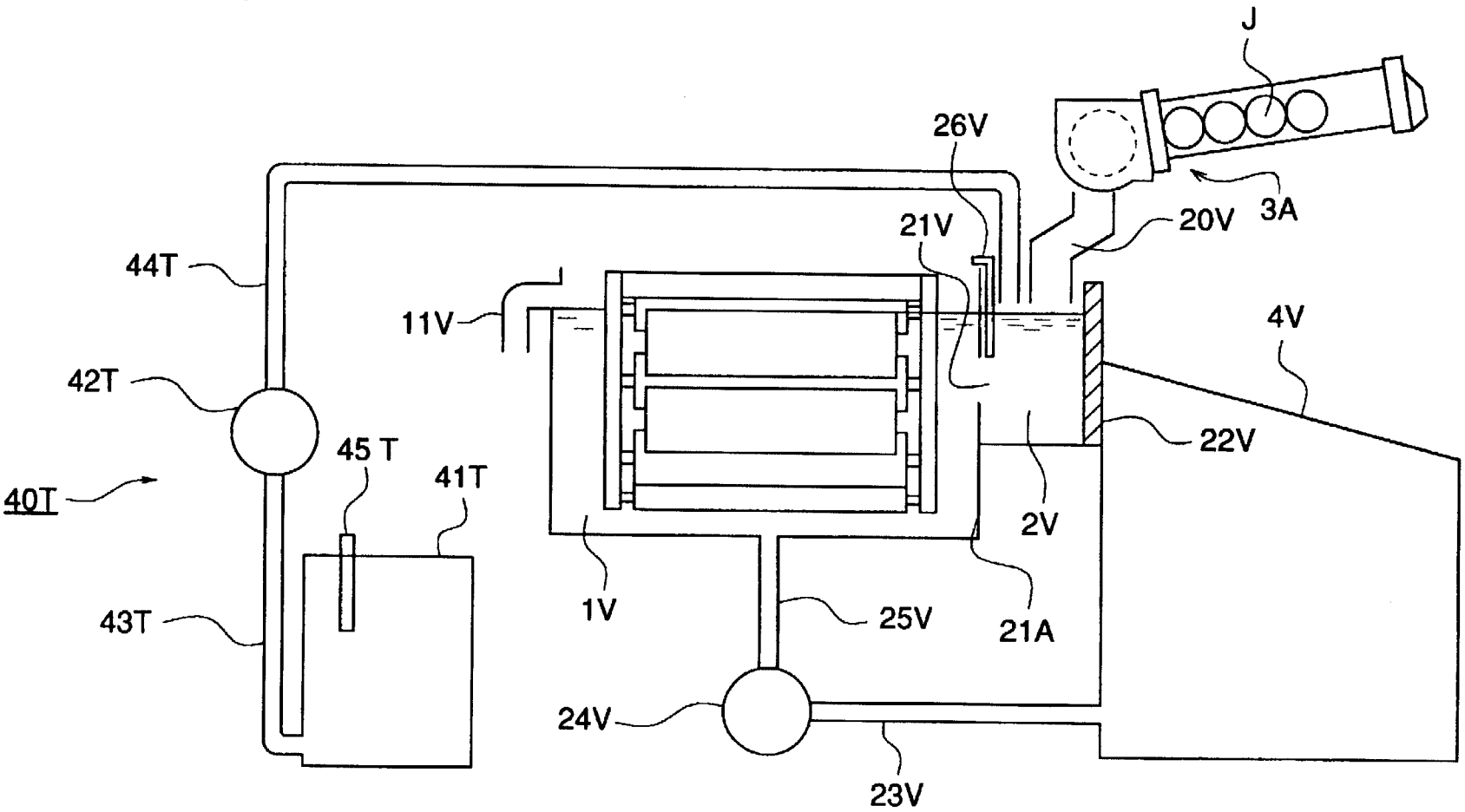
FIG. 5 is a schematic view showing the color developing tank of Example 1.

FIG. 3 is a cross-sectional of an auxiliary tank which is a processing tank and the solid processing agent supplying means at I—I cross section in FIG. 1, of the automatic processing machine A. Incidentally, the stabilizing processing tanks (the first stabilizing processing tank 1C, the second stabilizing processing tank 1D and the third stabilizing processing tank 1E) have the same structure as the bleach-fixing processing tank 1B. Therefore, hereunder, when a processing tank 1T is referred to, both the bleach-fixing processing tank 1B and the stabilizing processing tanks (the first stabilizing processing tank 1C, the second stabilizing processing tank 1D and the third stabilizing processing tank 1E) shall be referred. In addition, the color developing tank is shown in FIGS. 4 and 5. In FIG. 3, in order to simplify, the structure, the conveyance means which conveys the light-sensitive material is omitted. In addition, in the example of the present invention, a tablet agent is used for the solid processing agent. The processing tank 1T which processes the light-sensitive material has an auxiliary tank 2T integrally provided outside a partition wall which forms aforesaid processing tank 1. The tablet agent J, supplied from the solid processing agent supplying means 3A, 3B and 3E, passes through a solid processing agent supplying section 20T and is supplied to the auxiliary tank 2T. The above-mentioned 1T and the auxiliary 2T are partitioned by a partition wall 21A wherein a communication window 21T is formed so that the processing solution can be circulated.

A replaceable cylindrical filter 22T is provided in the auxiliary tank 2T. It functions to remove insolubles such as coagulation in the processing solution. The center of this filter 22T is communicated with the absorption side of a circulation pump 24T through a circulation pipe 23T which penetrates the lower wall of the auxiliary tank 2T.

The circulation system is structured by the auxiliary tank 2T, the circulation pipe 23T, the circulation pump 24T and a circulation pipe 25T, which form a circulation route of the solution and the processing tank 1T. The other end of the circulation pipe 25T which communicated with the emitting side of the above-mentioned pump 24T penetrates the lower wall of the processing tank 1T. Due to the above-mentioned structure, when the circulation pump 24T operates, the processing solution is pumped from the auxiliary tank 2T to the processing tank 1T so that the processing solution is mixed with the processing solution inside the processing tank 1T and fed back to the auxiliary tank 2T again. This circulation is continued. (In the present invention, the circulation direction of the processing solution is not necessary to be limited to a direction illustrated in FIG. 3, but may also be in the opposite direction.)

A bar heater 26T is provided in a manner that it penetrates the upper wall of the auxiliary tank 2T and is immersed in a processing solution inside the auxiliary tank 2T. This heater 26T heats the processing solution in the circulation route of the processing solution and a color developing tank 1N based on temperature sensed by a thermometer provided inside the auxiliary tank 2T but not illustrated. In other words, the heat 26T is a temperature regulating means which keeps the processing solution inside the processing tank iT to temperature range suitable for processing (for example. 20° to 55° C.).

Next, the structure of the color developing tank shown in FIG. 4 will be explained below. The color developing tank 1N which processes the light-sensitive material has an auxiliary tank 2N integrally provided outside a partition wall which forms aforesaid color developing tank 1N. A solid processing agent supplying chute 20N is provided over the auxiliary tank 2N. The tablet agent J supplied from the solid processing agent supplying means 3A passes through the solid processing agent supplying chute 20N and is fed to the auxiliary tank 2N. The above-mentioned color developing tank 1N and the auxiliary tank 2N are separated by a partition wall 21A wherein a communication window is formed so that the color developing solution can be circulated.

A replaceable cylindrical filter 22N is provided in the auxiliary tank 2N. Its function is to remove insoluble matter such as coagulation in the color developing solution. The center of this filter 22N is communicated with the in-feed side of a circulation pump 24N (a circulation means) through a circulation pipe 23N which penetrates the lower wall of the auxiliary tank 2N.

The above-mentioned circulation system is composed of the circulation route of the color developer solution formed by the auxiliary tank 2N, the circulation pipe 23N, the circulation pump 24N and a circulation pipe 25N, and the color developing tank 1N. The other end of the circulation pipe 25N, which communicates with the out-feed side of the above-mentioned circulation pump 24N, penetrates the lower wall of the color developing tank 1N. Due to the above-mentioned structure, when the circulation pump operates, the color developing solution is pumped from the auxiliary tank 2N and emitted to the color developing tank 1N. The color developing solution is mixed with the color developing solution inside the color developing tank 1N, and then, fed to the auxiliary tank 2N again. Thus, the circulation is repeated.

A bar heater 26N is provided in such a manner that it penetrates the upper wall of the auxiliary tank 2N and is immersed in the processing solution inside the auxiliary tank 2N. This heater 26N warms the processing solution in the circulation route of the processing solution and the color developing tank 1N based on temperature sensed by a thermostat housed inside the auxiliary tank 2N (not illustrated). In other words, the heater 26N is a temperature regulating means which keeps the processing solution inside the processing tank 1N in a temperature range suitable for processing (for example, 20° to 55° C.).

An effluent pipe 11N is provided for overflow of the color developing solution inside the color developing tank 1N. It is used for keeping the level of liquid surface and is also used to remove excess components from the light-sensitive material and to be prevented from increasing.

Next, the structure of the color developing tank shown in FIG. 5 will be explained below. The color developing tank IV which processes the light-sensitive material has an auxiliary tank 2V integrally provided outside a partition wall which forms aforesaid color developing tank 1V. A solid processing agent supplying chute 20V is provided over the auxiliary tank 2V. The tablet agent J fed from a solid processing agent supplying means 3A passes through the solid processing agent supplying chute 20V and is supplied to the auxiliary tank 2V. The above-mentioned color developing tank 1V and the auxiliary tank 2V are separated by a partition wall 21A wherein a communication window is formed so that a color developing solution can be circulated.

A replaceable flat filter 22V is housed in the auxiliary tank 2V in such a manner that it partitions auxiliary tank 2V and the above of the developing solution housing tank 4V. It functions to remove insoluble coagulation in the color developing solution. The lower portion of the developing solution housing tank 4V is connected to the in-feed side of the circulation pump 24V (a circulation means) through the circulation pipe 23V which penetrates a lower wall near the bottom of the developing solution housing tank 4V.

The above-mentioned circulation system is structured by the circulation route of the color developer solution formed by the auxiliary tank 2V, the developing solution housing tank 4V, the circulation pipe 23V, the circulation pump 24V and a circulation pipe 25V, and the color developing tank 1V. The other end of the circulation pipe 25V which is connected to the out-feed side of the above-mentioned circulation pump 24V penetrates the bottom of the color developing tank 1V. Due to the above-mentioned structure, when the circulation pump operates, the color developing solution is pumped from the auxiliary tank 2V to the color developing tank 1V. The color developing solution is mixed with the color developing solution inside the color developing tank 1V, and then, inserted to the auxiliary tank 2V. Thus, the circulation is continuously repeated.

An effluent pipe 11V is provided for the overflow of the color developing solution inside the color developing tank 1V. It is used for keeping the level of the liquid surface and is also used to remove excess components to be effused from the light-sensitive material and to be prevented from increasing.

As a sensing means for information about processing amount 31T, a photo-electric sensor is provided at the inlet portion of the automatic processing machine A as shown in FIG. 1 for sensing the processing amount of the light-sensitive material already processed. This sensing means, for information about processing amount 31T, is provided with plural sensing members to the left and right directions. This functions as an element for counting time sense as well as sensing the width of the light-sensitive material. Since the conveyance speed of the light-sensitive material is mechanically set in advance, the processed area of the light-sensitive material can be calculated from the additional information of width and time. (Incidentally, in the present invention, any system such as an infrared sensor, a micro switch and a supersonic sensor can be used for this sensing means for information about processing amount 31T provided that it can sense the width and conveyance time of the light-sensitive material such as an infrared sensor, a micro switch and a supersonic sensor. In addition, one which can sense processing area of the light-sensitive material indirectly such as one, in the case of a printer processor shown in FIG. 1, which senses the amount of light-sensitive material printed or senses the number of light-sensitive material processed having a predetermined area. In addition, time sensing is before being processed in the present invention. However, timing after being processed and during being immersion in the processing solution are also possible. In these occasions, a position to provide the sensing means for information about processing amount 31T may be changed to a position where the information can be sensed after being processed or where the information can be sensed during processing.

In addition, it is not to provide the sensing means for information about processing amount 31T for each of processing tank 1A, 1B, 1C, 1D and 1E. It is preferable to provide one sensing means for information about processing amount 31T to one unit of the automatic processing machine A.

Upon receiving a signal from the above-mentioned sensing means, for which provides information about the processing amount 31T, a solid processing agent supplying means 32T controls the supply of the processing agent from a solid processing agent supplying means 30T and also controls the supply of replenishing water through a replenishing water supplying means 40T.

As shown in FIG. 3, a solid processing agent supplying means 30T is provided above the processing tank 1T of the light-sensitive material processing apparatus which processes a light-sensitive material exposed. The solid processing agent supplying means 30T is composed of a housing container loading means 34T which loads a housing container D, a solid processing agent supplying means main body 35T which supplies the solid processing agent from the housing container D loaded in the housing container loading means 34T by a prescribed amount and a driving means 36T which drives the solid processing agent supplying means main body 35T, and closed by means of an upper cover 301T tightly. The upper cover 301T is bound by a main body 101T which houses the above-mentioned processing tank 1T and the auxiliary tank 2T and a supporting axis 302T so that aforesaid upper cover 301T can inspect a solid processing agent replenishing device 30T and replace the above-mentioned filter 22T by opening the front and the top from an operator side by being lifted to a direction of a dashed line A as illustrated. In addition, a cover 303T as part of the top of the upper cover 301T,, is hinged oscilatedly so that aforesaid cover 303T can be opened in the direction of the dashed line B, as illustrated, for loading and replacing the above-mentioned housing container 33T.

In the light-sensitive material processing apparatus main body 101T, a replenishing water supplying means 40T is provided in the vicinity of replenishing tank 2N, 2V and 2T. The replenishing water supplying means 40T is structured by a replenishing water tank 41T, a bellows pump 42T, a water-in-feed tube 43T, a water feeding tube 44T and a replenishing water heating means 45T. Replenishing water W housed in the replenishing water tank 41T is kept heated to a prescribed temperature by means of the replenishing water heating means 45T. In accordance with a signal from the control unit to supply replenishing water, due to the effect of bellows pump 42T, water is pumped through a suction tube 43T, and then, pumped above the liquid surface of the processing solution inside the auxiliary tank 2T through the water feeding tube 44T due to pressing effect of the bellows pump 42T. The driving motor of the above-mentioned bellows pump 42T is rotated due to the timing control by means of the replenishing water supplying and control means so that water is replenished as needed.

In the following manner, a solid processing agent for color photographic paper use was prepared.

[1] Preparation of a solid processing agent for color developing for color paper.

Procedure (1)

In a commercially available Bandam mill, 1350.0 g of a developing agent CD-3, i.e. 4-amino-3-methyl-N-ethyl-N-[β-(methanesulfonamido)ethyl]aniline sulfate was crushed to until an average grain size of 10 μm. To this powder, 1000.0 g of polyethylene glycol, whose average molecular weight by weight was added. The resulting mixture was mixed uniformly in a commercially available mixer. Next, in a commercially available stirrer-tableting machine, 50 ml of water was added to the resulting mixture for 7 minutes for granulating, and then, the granulated product was dried for 2 hours at 40° C. in a fluidized bed drier so that the moisture content of the tableted product was almost completely removed.

Procedure (2)

In the same manner as in Procedure (1), 400.0 g of disodium bis(sulfoethyl)hydroxylamine, 1700.0 g of sodium p-toluenesulfonic acid and 300.0 g of Chinopal SFP (produced by Chiba-Guigy) were respectively crushed. These substances and 240.0 g of Pine Flow (produced by Matsutani Chemical Co., Ltd.) were mixed uniformly in a commercially available mixer. Next, in the same manner as in Procedure (1), 60 ml of water was added so that the resulting mixture was granulated. The granulated product was dried for 2 hours at 50° C. so that moisture content in the granulated product was almost completely removed.

Procedure (3)

In the same manner as in Procedure (1), 330.0 g of pentasodium diethylenetriamine pentaacetic acid, 130.0 g of sodium p-toluenesulfonic acid, 37.0 g of sodium sulfite, 340.0 g of lithium oxide monohydrate and potassium carbonate anhydride were respectively crushed. These substances and 500.0 g of polyethylene glycol whose average molecular weight by weight is 4000, and 600.0 g of Mannitol were mixed uniformly by the use of a commercially mixer at a room whose humidity of 40% RH or less. Next, in the same manner as in Procedure (1), 800 ml of water was added so that the resulting mixture was granulated. The granulated product was dried for 30 minutes at 60° C. so that moisture content in the granulated product was almost completely removed.

Procedure (4)

All granulated products produced in Procedures (1) through (3) were mixed for 10 minutes by the use of a commercially available cross rotary type mixer at room temperature. To the resulting mixture, 50.0 g of sodium N-myristoyl-alanine was added uniformly for 3 minutes by the use of a commercially available mixer. The resulting mixture was subjected to continuous compression tableting wherein the diameter of a tablet was 30 mm, the thickness was 10 mm, the packing rate per tablet was 10.5 g and the tableting pressure was 7 t by the use of a rotary tableting machine (Clean Press Correct produced by Kikusui Seisakusho) so that a solid processing agent tablet for color developing for color paper was produced. This is defined to be solid processing agent ① for color developing.

[2] Preparation of a solid processing agent for bleach-fixing for color paper

Procedure (11)

In the same manner as in Procedure (1), 500.0 g of sodium carbonate monohydrate, 6000.0 g of ethylenediamine tetraacetic acid ferric ammonium trihydrate and 300.0 g of ethylenediamine tetraacetic acid were crushed to an average grain size of 10 μm. This fine powder was mixed in the same manner as in Procedure (1). After 200 ml of water was added to granulate the mixture in the same manner as in Procedure (1), the granulated product was dried for 3 hours at 60° C. in a fluidized bed drier so that the moisture content in the granulated product was almost completely removed.

Procedure (12)

In the same manner as in Procedure (1), 8000.0 g of ammonium thiosulfate and 3050.0 g of sodium methabisulfate were crushed. To the resulting mixture, 500.0 g of Pine Flow (produced by Matsutani Chemical Co., Ltd.) was added and mixed in the same manner as in Procedure (1). In the same manner as in Procedure (1), 170 ml of water was added to granulate the resulting mixture. After granulating, the granulated product was dried for 2 hours at 60° C. in the fluidized bed drier so that the moisture content in the granulated product was almost completely removed.

Granulated products obtained by Procedures (11) and (12) were mixed in the same manner as in Procedure (4). To the mixture, 1000.0 g of polyethylene glycol whose average molecular weight by weight is 40,000 and 97.0 g of sodium N-lauroyl sulcosine were added, and then, mixed in a room at 25° C. and 40% RH or less. Next, the resulting mixture was subjected to a rotary tableting machine (Tough Press Collect H18 produced by Kikusui Seisakusho) so that a solid processing agent tablet for bleach-fixing for color paper wherein the diameter is 30 mm and the weight is 11.0 g was prepared.

[3] Preparation of solid processing agent for color paper

Procedure (21)

In the same manner as in Procedure (1), 450.0 g of sodium carbonate-monohydrate, 3000.0 g of trisodium 1-hydroxyethane-1,1-diphosphoric acid, 150.0 g of disodium ethylenediamine tetraacetic acid and 70.0 g of o-phenyl phenol were crushed. To this mixture, 500.0 g of polyethylene glycol whose average molecular weight by weight was added and mixed in the same manner as in Procedure (1). To the resulting mixture, 60 ml of water was added and granulated in the same manner as in Procedure (1). Next, the granulated product was dried for 2 hours at 70° C. in a fluidized bed drier so that the moisture content in the granulated product was almost completely removed. To the granulated product prepared in the above-mentioned manner, 30.0 g of sodium N-lauroyl sulcosine was added, and then, mixed for 3 minutes in a room at 25° C. and 40% RH or less by the use of a mixer. Next, the resulting mixture was subjected to a rotary tableting machine (Tough Press Collect H18 produced by Kikusui Seisakusho) so that a solid processing agent tablet for stabilizing replenishing for color paper wherein the diameter is 30 mm and the weight is 10.5 g was prepared.

By the use of tablets prepared in the above-mentioned manner, after a photographic paper described in Example 1 of Japanese Patent O.P.I. Publication No. 264550/1992 wherein silver chloride content was 99.5 mol % was processed in an automatic processing machine wherein NPS 818 was modified as shown in the above-mentioned FIGS. 1 through 4, the paper was processed in accordance with the following steps.

| Processing step | Processing temperature | Processing time | Replenishing amount of solid processing agent | Added amount of replenishing water |
|---|---|---|---|---|
| Color developing | 42.0 ± 0.2° C. | 10 seconds | 7.8 g/m$^2$ | 65 ml/m$^2$ |
| Bleach-fixing | 38.0 ± 0.5° C. | 10 seconds | 6.2 g/m$^2$ | 80 ml/m$^2$ |
| First stabilizing | 38.0 ± 3.0° C. | 8 seconds | — | — |
| Second stabilizing | 38.0 ± 3.0° C. | 8 seconds | — | — |
| Third stabilizing | 38.0 ± 3.0° C. | 8 seconds | 1.0 g/m$^2$ | 180 ml/m$^2$ |
| Driving | 72.0 ± 5.0° C. | 25 seconds | — | — |

(Note) The replenishing amount of solid processing amount is that per 1 m$^2$ of photographic paper.

With regard to processing time in the color developing step, the time described in the above-mentioned table was controlled by adjusting the length of the processing racks shown in FIG. 4.

The stabilizing processing tanks employed a counter-flow system wherein a solution flows from the third stabilizing processing tank to the first stabilizing processing tank. In the overflowing solution from the first stabilizing processing tank, 80 ml/m$^2$ flows into a bleach-fixing processing tank as replenishing water. Tablets were set into a tablet supplying device provided for the automatic processing machine. The supplied amount per time was 1 tablet (10.5 g) for color developing, 2 tablets (22.0 g) for bleach-fixing and 1 tablet (10.5 g) for stabilizing. The supplying interval was adjusted until the replenishing amount of solid processing agent resulted in the above-mentioned values. In addition, in combination with the above-mentioned supplying rate, replenishing water was also replenished. The amount of replenishing water per time was adjusted in combination with the above-mentioned supplying of solid processing agents. Under the above-mentioned conditions, processing was conducted. In addition, with regard to the initial solution of each processing tank of the automatic processing machine, those regulated by the following formulas were used.

| [Color developing solution (per 1 l)] | |
|---|---|
| Sodium sulfite | 0.05 g |
| Pentasodium diethylene triamine pentaacetic acid | 3.0 g |
| Polyethylene glycol whose average molecular weight by weight is 4000 | 10.0 g |
| Sodium bis(sulfoethyl)hydroxylamine | 4.0 g |
| Chinopal SFP (prqduced by Chiba-Guigy) | 1.0 g |
| Sodium p-toluene sulfonic acid | 30.0 g |
| Mannito | 6.0 g |
| Potassium chloride | 4.0 g |
| Pine Flow | 3.0 g |
| Color developing agent: 3-methyl-4-amino-N-ethyl-N-(β-methanesulfonamidoethyl)-aniline sulfate [CD-3] | 8.0 g |
| Potassium carbonate | 33.0 g |
| Lithium hydroxide | 3.5 g |
| Sodium N-myristoyl alanine | 0.30 g |

pH was regulated to 10.00±0.05 by the use of potassium hydroxide or sulfuric acid.

| [Bleach-fixing solution (per l)] | |
|---|---|
| Sodium ethylenediamine tetraacetic acid ferric monohydrate | 60.0 g |
| Ethylenediamine tetraacetic acid | 6.7 g |
| Ammonium thiosulfate | 72.0 g |
| Sodium thiosulfate | 8.0 g |
| Ammonium methabisulfite | 7.5 g |

By the use of potassium carbonate or maleic acid, pH was regulated to 6.0±0.5.

| [Stabilizing solution (per l)] | |
|---|---|
| Trisodium 1-hydroxyethilidene-1,1-disulfonic acid | 3.0 g |
| Disodium ethylene diamine tetraacetic acid | 1.5 g |
| Sodium carbonate | 0.5 g |
| o-phenylphenol | 0.08 g |

By the use of sodium carbonate or sulfuric acid, pH was regulated to 8.0±0.5.

In addition, as a comparative, a replenishing solution having the same ratio between the replenishing amount of solid processing agent and the added amount of replenishing solution as shown in the above-mentioned processing step was prepared. A light-sensitive material was processed by the use of the above-mentioned comparative replenishing solution in an automatic processing machine Nice Print System NPS 818 (produced by Konica) employing a conventional replenishing solution replenishing system wherein the structure is not modified to that shown in the above-mentioned FIG. 1. In this occasion, the replenishing amount of each processing solution was regulated to be the total amount of the supplying amount of solid processing agent shown in the processing step and the added amount of replenishing water to be processed (in Table 1, this system is referred to as "a conventional replenishing solution system").

A light-sensitive material was subjected to running processing wherein a considerable amount of water was added as occasion called for off-set for the evaporation amount of each processing tank in accordance with the above-mentioned processing step by the use of a color developing tank shown in FIG. 4 and that shown in FIG. 5. The running processing was conducted for 12 hours which is a useal working durations of the automatic processing machine and continued for 2 weeks wherein 2.5 $m^2$ of color paper was continuously processed per day.

Differences of the color developing tank shown in FIG. 4 and that shown in FIG. 5 will be shown as follows.

TABLE 1

| | Volume of the processing solution in the processing tank (Vw) | Volume of the processing solution in the circulation route (Vf) | Volume of a total processing solution (Vt) | Flow rate circulated (Vc) | Ratio of aperture area (N) |
|---|---|---|---|---|---|
| System shown in FIG. 4 | 10 L | 2 L | 12 L | 10 L/min. | 8 $cm^2$/L |
| System shown in FIG. 5 | 2 L | 10 L | 12 L | 10 L/min. | 8 $cm^2$/L |

(Experiment 1: Occurrence of stain due to running)

At the stage of initial solution and after running processing, color paper samples subjected to wedge exposure to light by means of a conventional method were processed. The minimum reflection density (Dmin (Y)) was measured by means of a color analyzer TOPSCAN MODEL tc-1800mKII (produced by Tokyo Denshoku Co., Ltd.). The difference of Dmin (Y) after running processing and that at the initial solution stage was defined to be the degree of the occurrence of stain due to the running.

During running processing, color paper samples subjected to wedge exposure to light in accordance with a conventional method were processed. Their maximum reflection blue density (Dmax (Y)) was measured by the Use of X-rite (produced by Nihon Heihan Kizai Co., Ltd.). The difference of the maximum Dmax (Y) and the minimum Dmax (Y) was defined to be processing stability.

The condition of the solution inside the color developing tank during running processing was evaluated in accordance with the following criteria:

(Coagulation)

O: Coagulation was scarcely observed. There was no specific problem.

Δ: Coagulation was observed a little inside the tank wall or racks.

X: Excessive coagulation was observed.

TABLE 2

| Experiment No. | Replenishment system | Color developing processing tank | Occurrence of stain | Processing stability | Coagulation of processing agent | Remarks |
|---|---|---|---|---|---|---|
| 1-1 | Conventional replenishing system | FIG. 4 | 0.053 | 0.18 | X | Comp. |
| 1-2 | Solid processing agent | FIG. 4 | 0.042 | 0.15 | X | Comp. |
| 1-3 | Solid processing agent | FIG. 5 | 0.015 | 0.03 | O | Inv. |

As is apparent from the above-mentioned table, it was confirmed that, when the volume of developing solution housed in the above-mentioned developing tank Vw (liter) and the volume of developing solution housed in the above-mentioned circulation route satisfies Vw≦Vf, deterioration of the white background due to the oxidation of developing agent (the occurrence of stain) can be presented and that stable processing property and solution storage stability can be kept even when the processing amount per time is small.

Another experiment was conducted in the same manner as in Example 1 by the use of the color developing tank shown in FIG. 4 and the color developing tank shown in FIG. 5, except that the circulating flow rate of the developing solution Vc (liter/minute) of the developing solution which circulates in the circulation route and the total inlet area Se ($cm^2$) of the inlet port of the developing solution circulating in the developing tank. Table 3 shows the results thereof.

TABLE 3

| Experiment No. | Replenishing system | CD processing tank | Vw | Vc | Se | Vc/Vw | Vc/Se | Occurrence of stain | Processing stability | Coagulation |
|---|---|---|---|---|---|---|---|---|---|---|
| 2-1 | Conventional replenishing soluiton type | FIG. 4 | 10 L | 10 L/min | 12.5 $cm^2$ | 1 | 0.8 | 0.053 | 0.18 | X |
| 2-2 | Solid processing agent | FIG. 4 | 10 | 10 | 12.5 | 1 | 0.8 | 0.042 | 0.15 | X |
| 2-3 | Solid processing agent | FIG. 5 | 2 | 5 | 12.5 | 2.5 | 0.8 | 0.021 | 0.05 | Δ |

TABLE 3-continued

| Experiment No. | Replenishing system | CD processing tank | Vw | Vc | Se | Vc/Vw | Vc/Se | Occurrence of stain | Processing stability | Coagulation |
|---|---|---|---|---|---|---|---|---|---|---|
| 2-4 | Solid processing agent | FIG. 5 | 2 | 10 | 12.5 | 5 | 0.8 | 0.015 | 0.03 | ○ |
| 2-5 | Solid processing agent | FIG. 5 | 2 | 20 | 12.5 | 10 | 0.8 | 0.013 | 0.01 | ○ |
| 2-6 | Solid processing agent | FIG. 5 | 1 | 30 | 12.5 | 30 | 0.8 | 0.013 | 0.01 | ○ |
| 2-7 | Solid processing agent | FIG. 5 | 1 | 40 | 12.5 | 40 | 0.8 | 0.017 | 0.04 | ○ |
| 2-8 | Solid processing agent | FIG. 5 | 1 | 50 | 12.5 | 50 | 0.8 | 0.023 | 0.06 | Δ |
| 2-9 | Solid processing agent | FIG. 5 | 2 | 20 | 67 | 10 | 0.3 | 0.024 | 0.06 | Δ |
| 2-10 | Solid processing agent | FIG. 5 | 2 | 20 | 40 | 10 | 0.5 | 0.017 | 0.03 | ○ |
| 2-11 | Solid processing agent | FIG. 5 | 2 | 20 | 20 | 10 | 1 | 0.013 | 0.01 | ○ |
| 2-12 | Solid processing agent | FIG. 5 | 2 | 20 | 6.7 | 10 | 3 | 0.013 | 0.01 | ○ |
| 2-13 | Solid processing agent | FIG. 5 | 2 | 20 | 4 | 10 | 5 | 0.017 | 0.04 | ○ |
| 2-14 | Solid processing agent | FIG. 5 | 2 | 20 | 2.9 | 10 | 7 | 0.023 | 0.04 | Δ |

As is apparent from Table 3, when the circulating flow rate of the developing solution Vc (liter/minute) of a developing solution which circulates the circulation route and the total inlet area Se ($cm^2$) of the inlet port of the developing solution circulating in the developing tank satisfies $$0.5\times Se \leqq Vc \leqq 5\times Se$$

it was confirmed that the effects of the present invention are provided more favorably.

Figure 6:
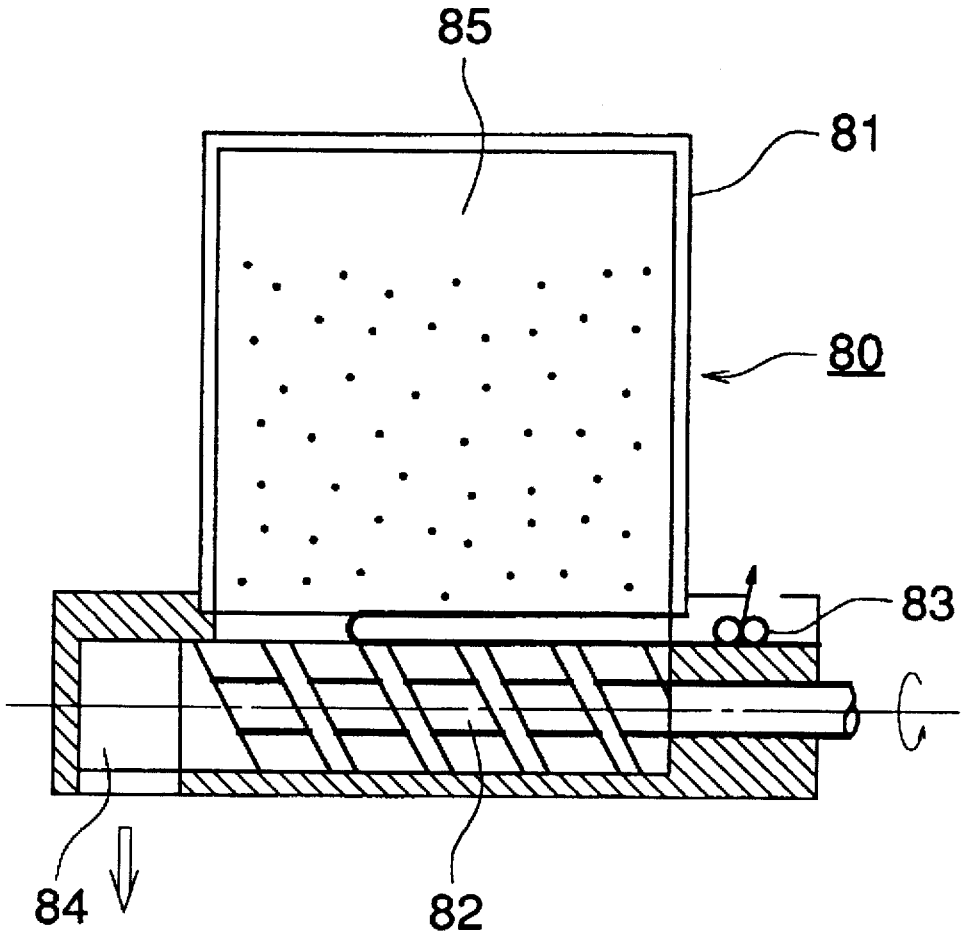
FIG. 6 is a cross-section view of a granule processing agent supplying apparatus of the example of a variation of Example 1.

In addition, the same experiment as above was conducted except that the structure of the supplying device was changed as shown in FIG. 6 and granules before being tableted were used in place of the solid processing agent, and the same results were obtained. FIG. 6 is a cross-sectional view showing a solid processing supplying device other than the present Example. A supplying device 80 supplies a granulated chemical by means of exiting portion 84 wherein a package 81 containing a granule processing agent was attached (loaded), the package was automatically opened by means of a roller 83 and the rotations of screw 82 was controlled.

(EXAMPLE 2)

Figure 7:
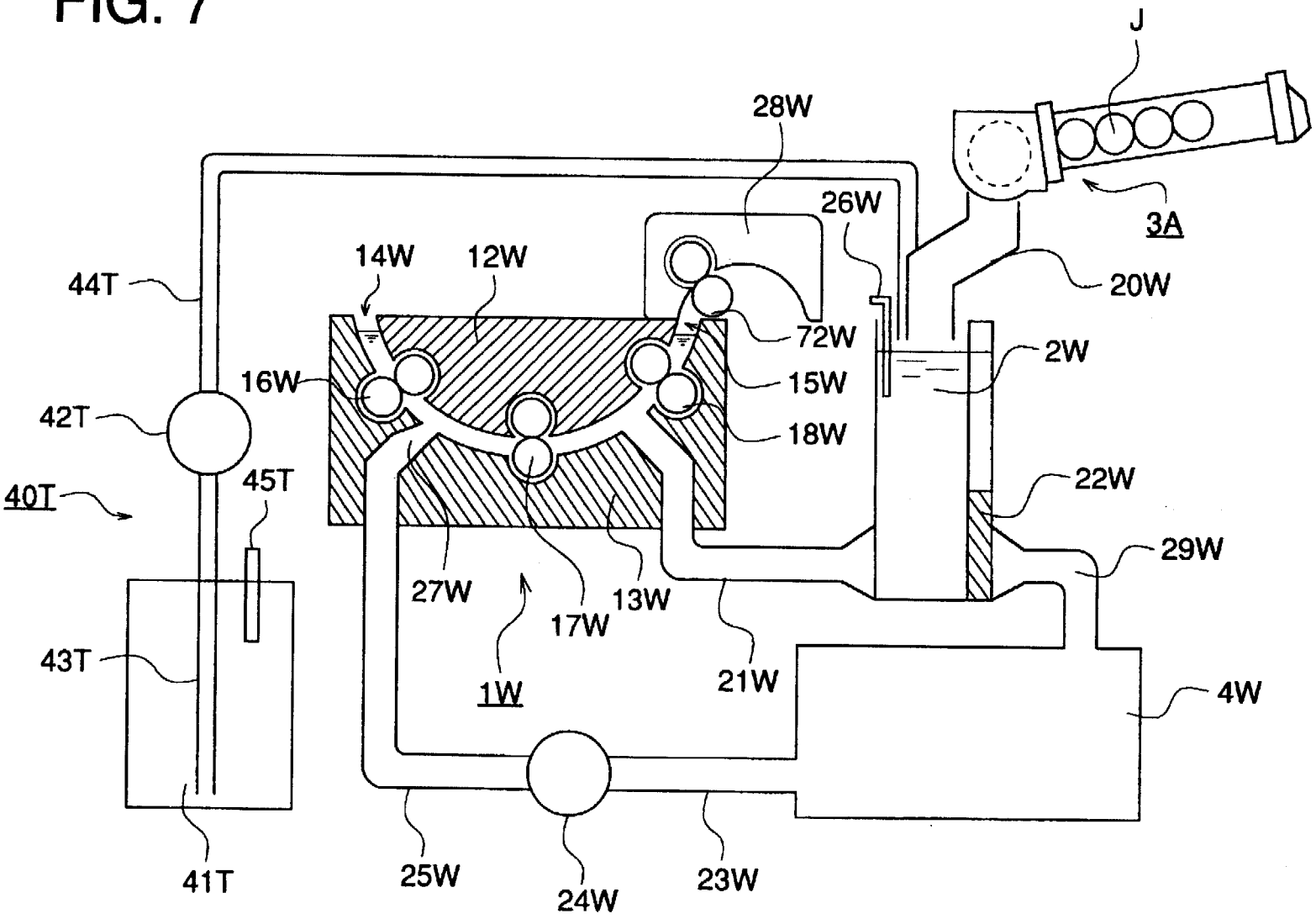
FIG. 7 is a schematic view showing a color developing tank of Example 2.

The present example employed a color developing tank shown in FIG. 7 in place of the color developing tank shown in FIG. 5 in Example 1. The structure of the color developing tank shown in FIG. 7 will be explained hereunder.

A color developing tank 1W, which processes a light-sensitive material, is composed of a lower member 13W which regulates the form of the lower half of the processing tank which goes along the conveyance route and which serves as a conveyance guide for the silver halide photographic light-sensitive material, an upper member 12W which regulates the form of the lower side of a processing tank which goes along the conveyance route and which serves as a conveyance guide for the silver halide photographic light-sensitive material and conveyance rollers 16W, 17W and 18W which transport the silver halide photographic light-sensitive material on the conveyance route between the lower member 13W and the upper member 12W for conveying the silver halide photographic light-sensitive material. Only insertion port 14W and exiting port 15W, which are defined between the lower member 13W and the upper member 12W, which forms gas/liquid interface for a color developing solution which is in the color developing tank 1W. In addition, a cross-over guide 28W which is provided at the dowm stream side of the conveyance route at the exiting port 15W in contact with the upper member 12W and a pair of cross-over rollers 72W which are paired rollers facing each other for conveying the silver halide photographic light-sensitive material along with the cross-over guide 28W are provided.

Beside the color developing tank 1W which processes the light-sensitive material, an auxiliary tank 2W, provided separately from the color developing tank 1W, is provided. A circulation pipe 21W which connects the color developing tank 1W and the lower portion of the auxiliary tank 2W is provided to allow the color developing solution to flow. Above the auxiliary tank 2W, a solid processing agent supplying unit 20W is provided. Tablets J supplied from a solid processing agent supplying means 3A passes the solid processing agent supplying chute 20W, and are dropped into the auxiliary tank 2W.

A bar heater 26W is provided in such a manner that it penetrates the upper wall of the auxiliary tank 2W and is immersed in the processing solution inside the auxiliary tank 2W. This heater 26W warms the processing solution in the circulation route of the processing solution and the color developing tank 1W based on temperature sensed by a thermostat housed inside the auxiliary tank 2W (not illustrated). In other words, the heater 26W is a temperature regulating means which keeps the processing solution inside the processing tank 1W in a temperature range suitable for processing (for example, 20° to 55° C.).

A replaceable flat filter 22W is housed in the auxiliary tank 2W in such a manner that it partitions the lower portion of auxiliary tank 2W and the circulation pipe 29W communicating with the above developing solution housing tank 4W. It functions to remove insoluble coagulations in the color developing solution. The circulation pipe 29W communicates with the lower portion of the auxiliary tank 2W and the upper portion of the developing solution housing tank 4W. The lower portion of the developing solution housing tank 4W is connected to the in-feed side of the circulation pump 24W (a circulation means) through the circulation pipe 23W which penetrates a wall near the bottom of the developing solution housing tank 4W.

The above-mentioned circulation system is structured by the circulation route of the color developer solution formed by the circulation pipe 21W,. the auxiliary tank 2W, the circulation pipe 29W, the developing solution housing tank 4W, the circulation pipe 23W, the circulation pump 24W and a circulation pipe 25W, and the color developing tank 1W. The other end of the circulation pipe 25W which is connected to the out-feed side of the above-mentioned circulation pump 24W penetrates the bottom of the color developing tank 1W. Due to the above-mentioned structure, when the circulation pump operates, the color developing solution is pumped from the auxiliary tank 2W to the color developing tank 1W. The color developing solution is mixed with the color developing solution inside the color developing tank 1W, and then, pumped to the auxiliary tank 2W. Thus, the circulation is continuously repeated.

With regard to each numeral of this example, the volume Vw of the color developing solution housed in the color developing tank 1W which processes a light-sensitive material was 1 liter. The volume Vf of the color developing solution in the circulation route was 4 liters. The circulation flow rate Vc of the color developing solution which occurs due to circulation pump 24W was 10 liters/minute. The total flowing-in cross-sectional area Se at the flowing-in port 14 W of the processing solution which circulates in the photographic processing was 10 $cm^2$. The aperture area ratio N was 8 $cm^2$/liter.

EXAMPLE 3

Figure 8:
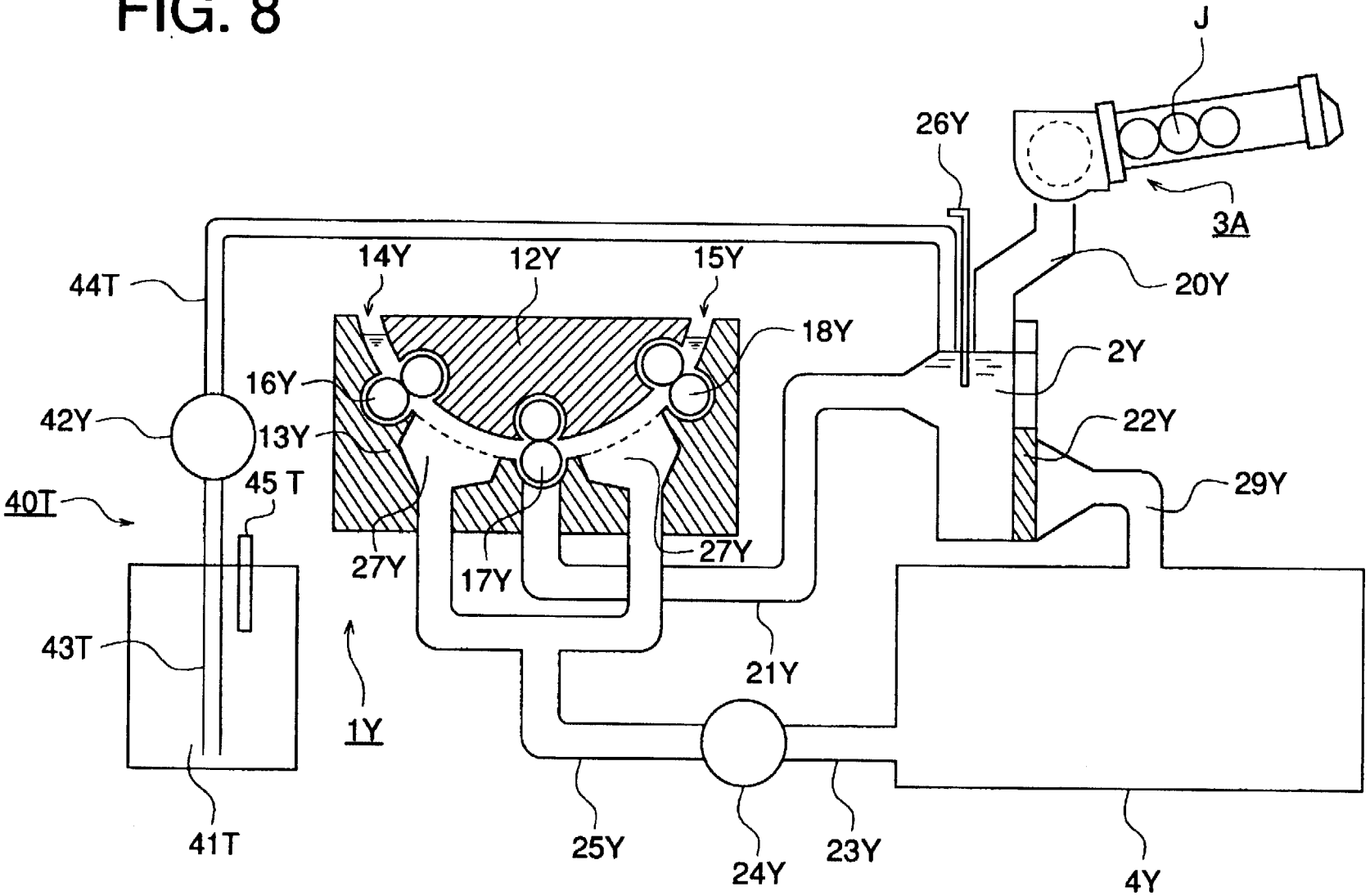
FIG. 8 is a schematic view showing a color developing tank of Example 3.
Figure 9:
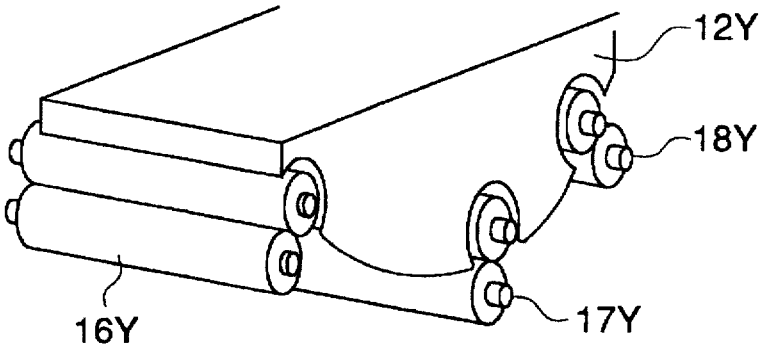
FIG. 9 (A) through 9 (C) are diagrams of a color developing tank of Example 3.
Figure 9:
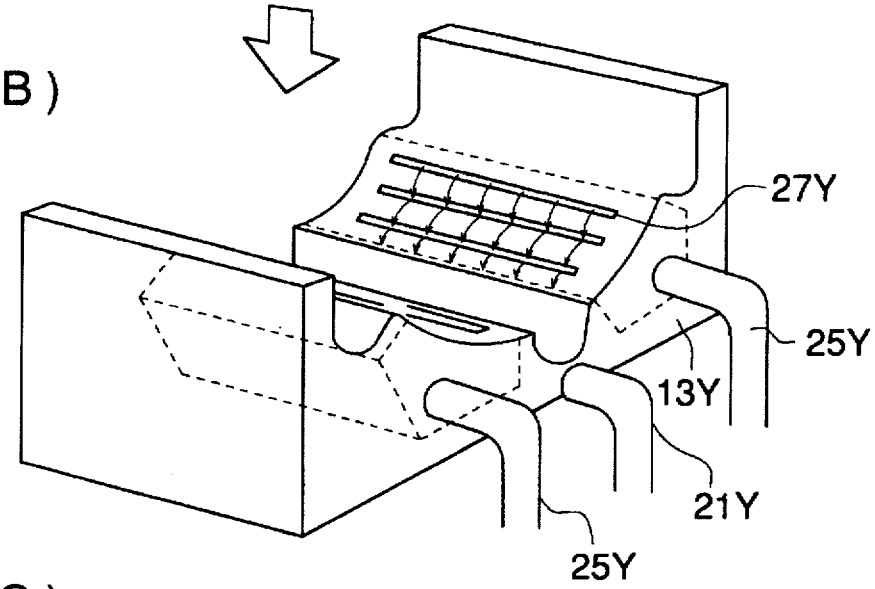
Figure 9:
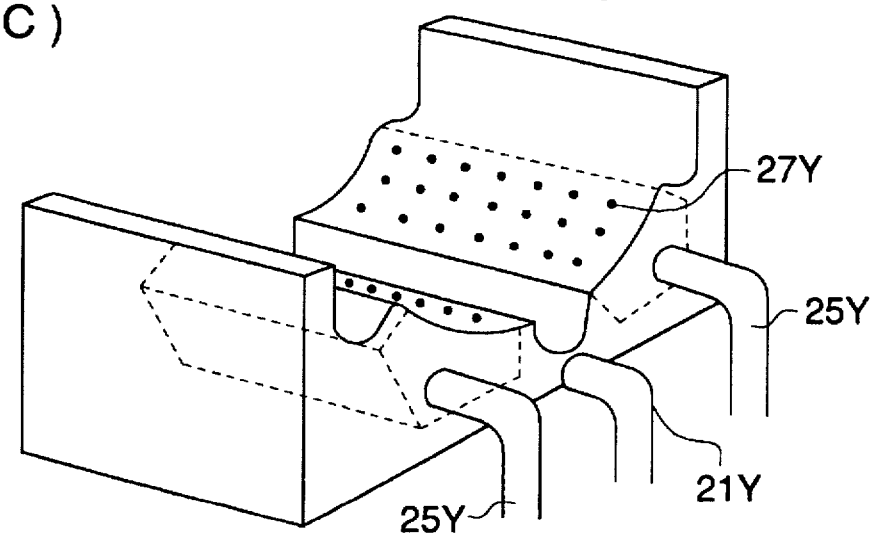

The present example employs a color developing tank shown in FIGS. 8 and 9 in place of the color developing tank shown in FIG. 7 of Example 2.

A color developing tank 1Y which processes the light-sensitive material is composed of a lower member 13Y which regulates the form of the lower half of the processing tank which follows the conveyance route and which serves as a conveyance guide for the silver halide photographic light-sensitive material, an upper member 12Y which regulates the form of the lower side of a processing tank which follows the conveyance route and which serves as a conveyance guide for the silver halide photographic light-sensitive material and conveyance rollers 16Y, 17Y and 18Y which drive the silver halide photographic light-sensitive material on the conveyance route between the lower member 13Y and the upper member 12Y for conveying the silver halide photographic light-sensitive material. Only an insertion port 14Y and an exiting port 15Y which are defined between the lower member 13Y and the upper member 12Y are gas/liquid interfacesfor a color developing solution which is in the color developing tank 1Y. In addition, though not illustrated, a cross-over guide 28Y which is provided at a lower stream side of the conveyance route at the exiting port 15Y in contact with the upper member 12Y and a pair of cross-over rollers 29Y which are rollers facing each other for conveying the silver halide photographic light-sensitive material along with the cross-over guide 28Y are provided.

Beside the color developing tank 1Y which processes the light-sensitive material, an auxiliary tank 2Y, provided separately from the color developing tank 1Y, is provided. A circulation pipe 21Y which connects the color developing tank 1Y and the lower portion of the auxiliary tank 2Y is provided to allow the color developing solution to flow. Above the auxiliary tank 2Y, a solid processing agent supplying unit 20Y is provided. Tablets J supplied from a solid processing agent supplying means 3A pass down the solid processing agent supplying chute 20Y, and are supplied to the auxiliary tank 2Y.

A bar heater 26Y is provided in a manner that it penetrates the upper wall of the auxiliary tank 2Y and is immersed in the processing solution inside the auxiliary tank 2Y. This heater 26Y warms the processing solution in the circulation route of the processing solution and in the color developing tank 1N based on the temperature sensed by a thermostat provided inside auxiliary tank 2Y but not illustrated. In other words, the heater 26Y is a temperature regulating means which keeps the processing solution inside the processing tank 1Y in a temperature range suitable for processing (for example. 20° to 55° C.).

A replaceable flat filter 22Y is housed in auxiliary tank 2Y in such a manner that it partitions the lower portion of auxiliary tank 2Y and the circulation pipe 29Y communicating with the above developing solution housing tank 4Y. It functions to remove insoluble coagulation in the color developing solution. The circulation pipe 29Y communicates with the lower portion of the auxiliary tank 2Y and the upper portion of the developing solution housing tank 4Y. The lower portion of the developing solution housing tank 4Y is connected to the in-feed side of the circulation pump 24Y (a circulation means) through the circulation pipe 23Y which penetrates a wall near the bottom of the developing solution housing tank 4Y.

The above-mentioned circulation system is structured by the circulation route for the color developer solution formed by the auxiliary tank 2Y, the circulation pipe 29Y, the developing solution housing tank 4Y, the circulation pipe 23Y, circulation pump 24Y and circulation pipe 25Y, and the color developing tank 1Y. The other end of the circulation pipe 25Y which is connected to the out-feed side of the above-mentioned circulation pump 24Y penetrates the bottom of the color developing tank 1Y. Due to the above-mentioned structure, when the circulation pump operates, the color developing solution is pumped from the auxiliary tank 2Y to the color developing tank 1Y. The color developing solution is mixed with the color developing solution inside the color developing tank 1Y, and then, pumped to the auxiliary tank 2Y. Thus, the circulation is continuously repeated.

With regard to each numeral of this example, the volume Vw of the color developing solution housed in the color developing tank 1Y which processes a light-sensitive material was 1 liter. The volume Vf of the color developing solution in the circulation route was 4.5 liters. The circulation flow rate Vc of the color developing solution which fed by circulation pump 24Y was 10 liters/minute. The total flowing-in cross-sectional area Se at the flowing-in port of the processing solution which circulates in the photographic processing was 8 $cm^2$. The aperture area ratio N was 7 $cm^2$/liter.

FIG. 9 shows practical structure of the color developing tank 1Y. FIG. 9 (A) shows the upper member 12Y which defines the form of the upper half of the processing tank which follows the conveyance route of the color developing tank 1Y and serves as the conveyance guide of the silver halide photographic light-sensitive material and also shows the conveyance rollers 16Y, 17Y and 18Y which drive the silver halide photographic light-sensitive material in the conveyance route between the lower member 13Y and the upper member 12Y for conveyance. FIG. 9 (B) is a figure showing an example of the lower member 13Y which defines the form of the lower half of the processing tank which follows the conveyance route in the color developing tank 1Y and which also serves as the conveyance guide for the silver halide photographic light-sensitive material too in the color developing tank 1Y. Plural number of nozzles 27Y which emit the color developing solution uniformly in a transversal direction are provided in the transversal direction, and which are longer than the width of the light-sensitive material being conveyed. FIG. 9 (C) is a figure showing an another example of the lower member 13Y which defines the form of the lower half of the processing tank which follows the conveyance route in the color developing tank 1Y and which also serves as the conveyance guide for the silver halide photographic light-sensitive material too in the color developing tank 1Y. There are provided many holes uniformly in the direction of conveying the light-sensitive material with the wider width than that of the light-sensitive material conveyed.

EXAMPLE 4

Figure 10:
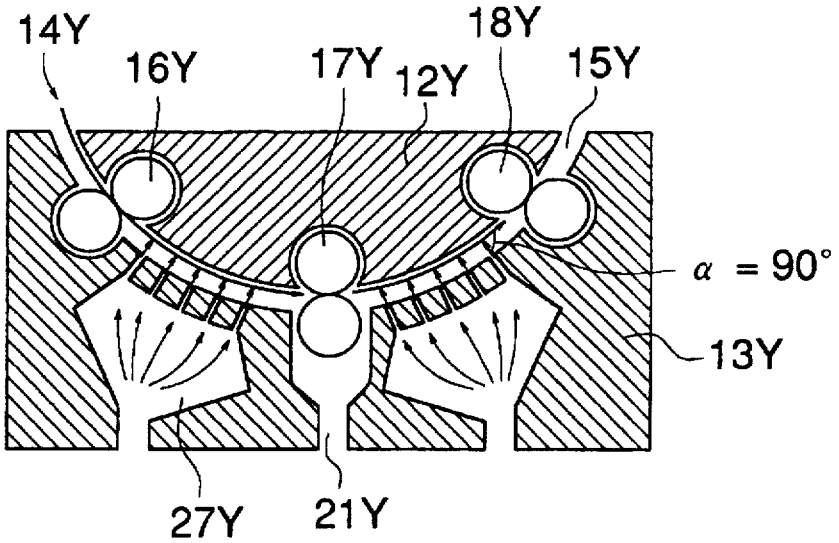
FIGS. 10 (A) and 10 (B) are diagrams of a color developing tank of Example 4.
Figure 10:
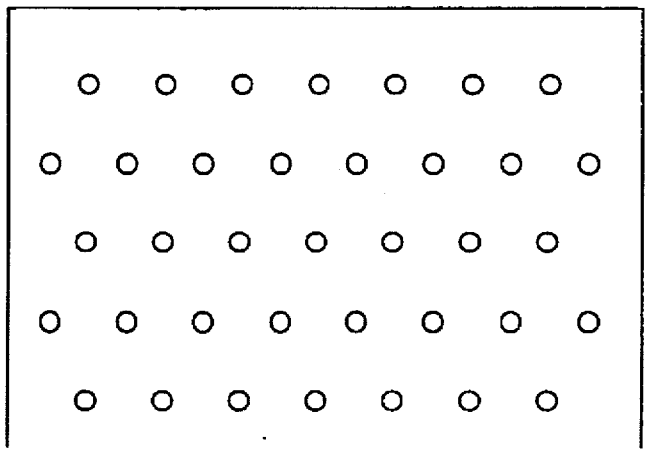

The present example employs a color developing tank shown in FIG. 10 in place of the color developing tank shown in FIGS. 8 and 9 (A) and (B).

FIG. 10 shows a practical example of the color developing tank 1Y. FIG. 10 (A) shows a form of the color developing tank 1Y. FIG. 10 (A) shows location thereof viewing from the emitting direction of the nozzle 27Y. In order to emit the color developing solution uniformly in the transversal direction, plural rows of nozzles are provided wherein the width of each row is wider than the width of light-sensitive material conveyed and the intervals thereof are uniform. These nozzles take right angle to the direction of conveying the light-sensitive material. As shown in FIG. 10 (B), nozzles 27Y are provided in equivalent intervals. In adjoining rows, nozzles are shifted by ½ pitch. As a whole, the nozzles are provided totteringty. Since these nozzles are provided alternately to the conveyance direction, development unevenness occurs rarely. These nozzles blow pressed processing solution from holes whose diameters are 1.5 to 2.0 mm at blowing angle of 90°.

Figure 11:
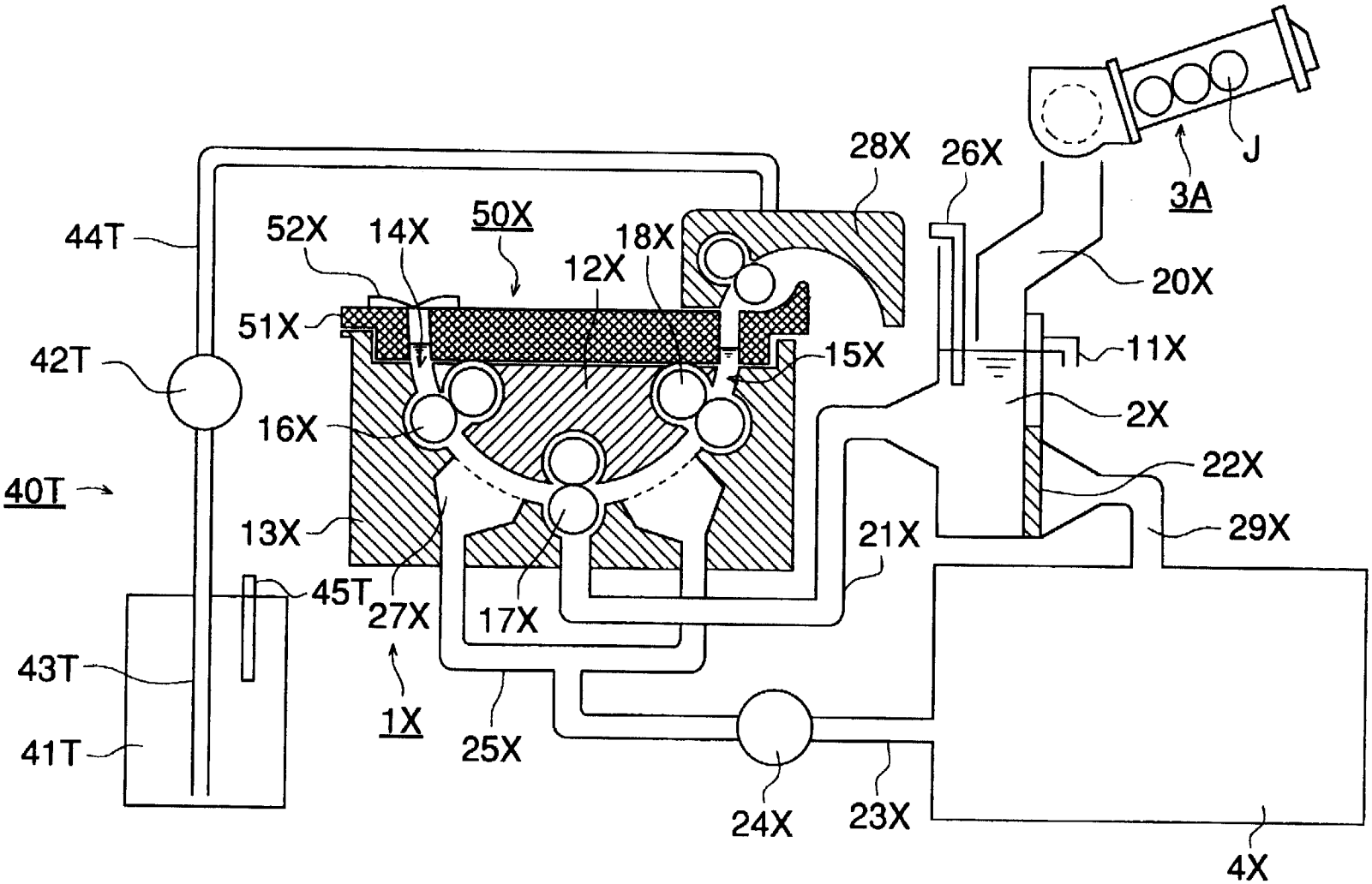
FIG. 11 is a schematic view showing a color developing tank of Example 5.
Figure 12:
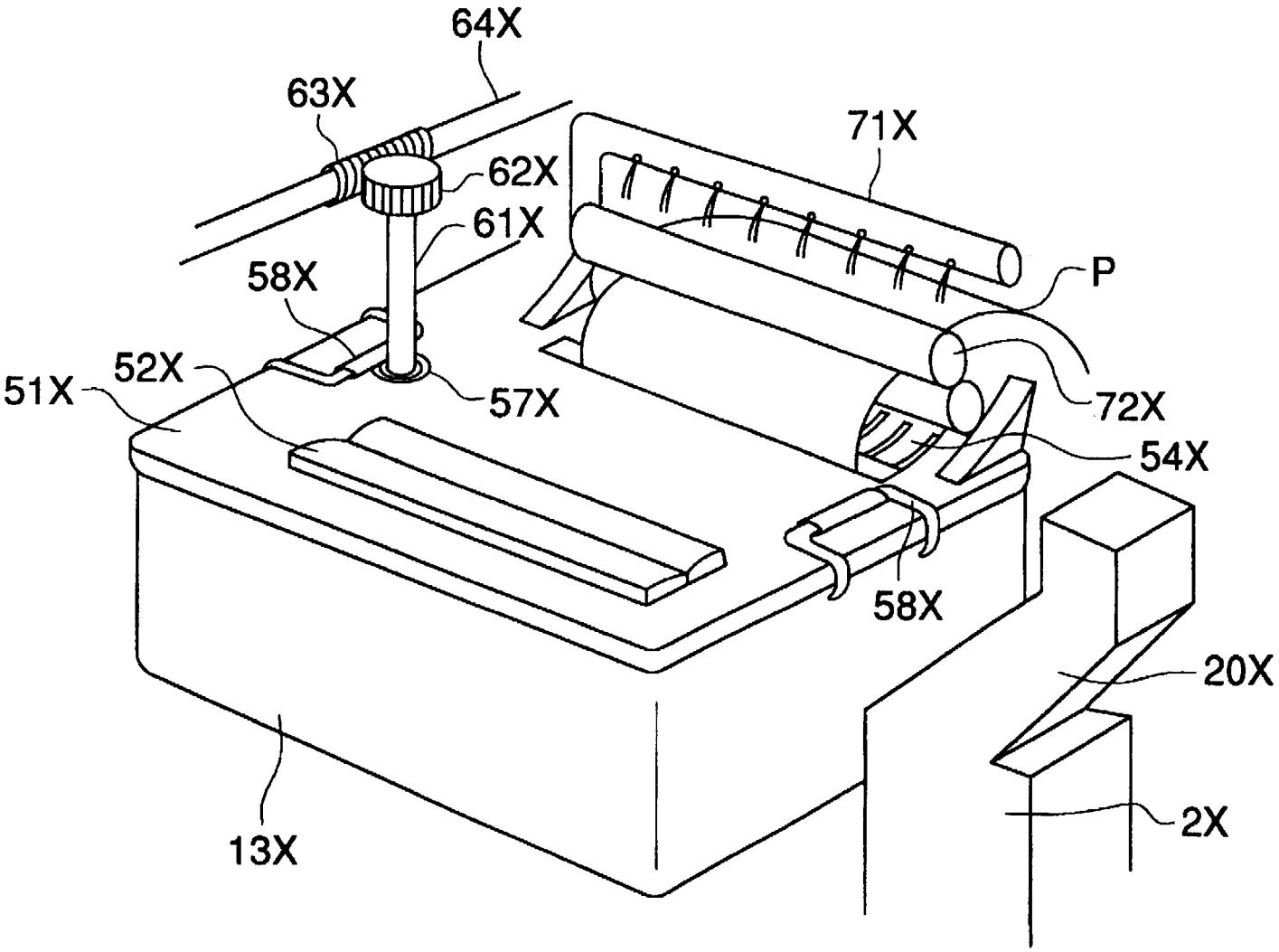
FIG. 12 is a perspective view showing a color developing tank of Example 5.
Figure 13:
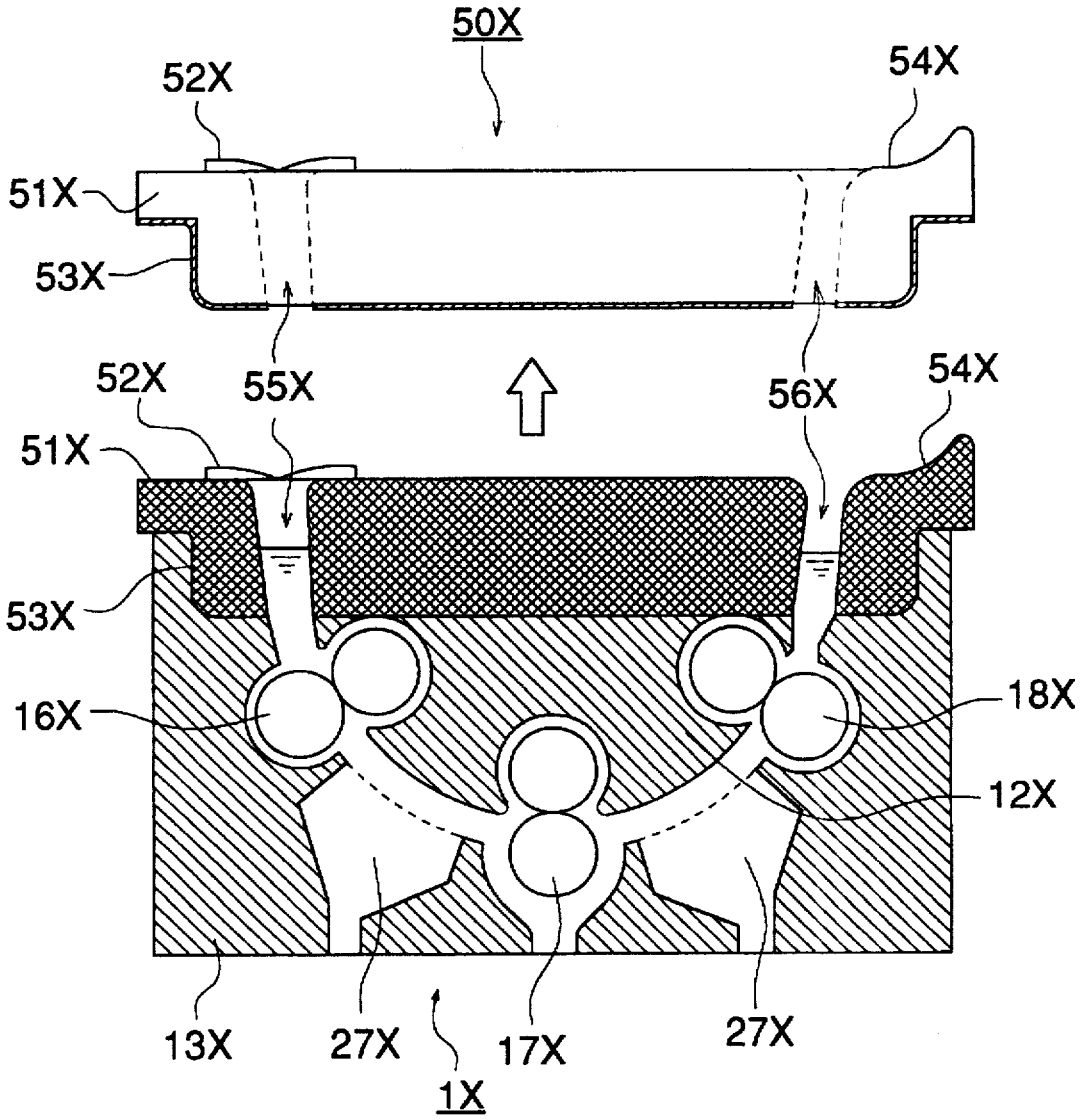
FIG. 13 is a cross-sectional view showing a color developing tank of Example 5.
Figure 14:
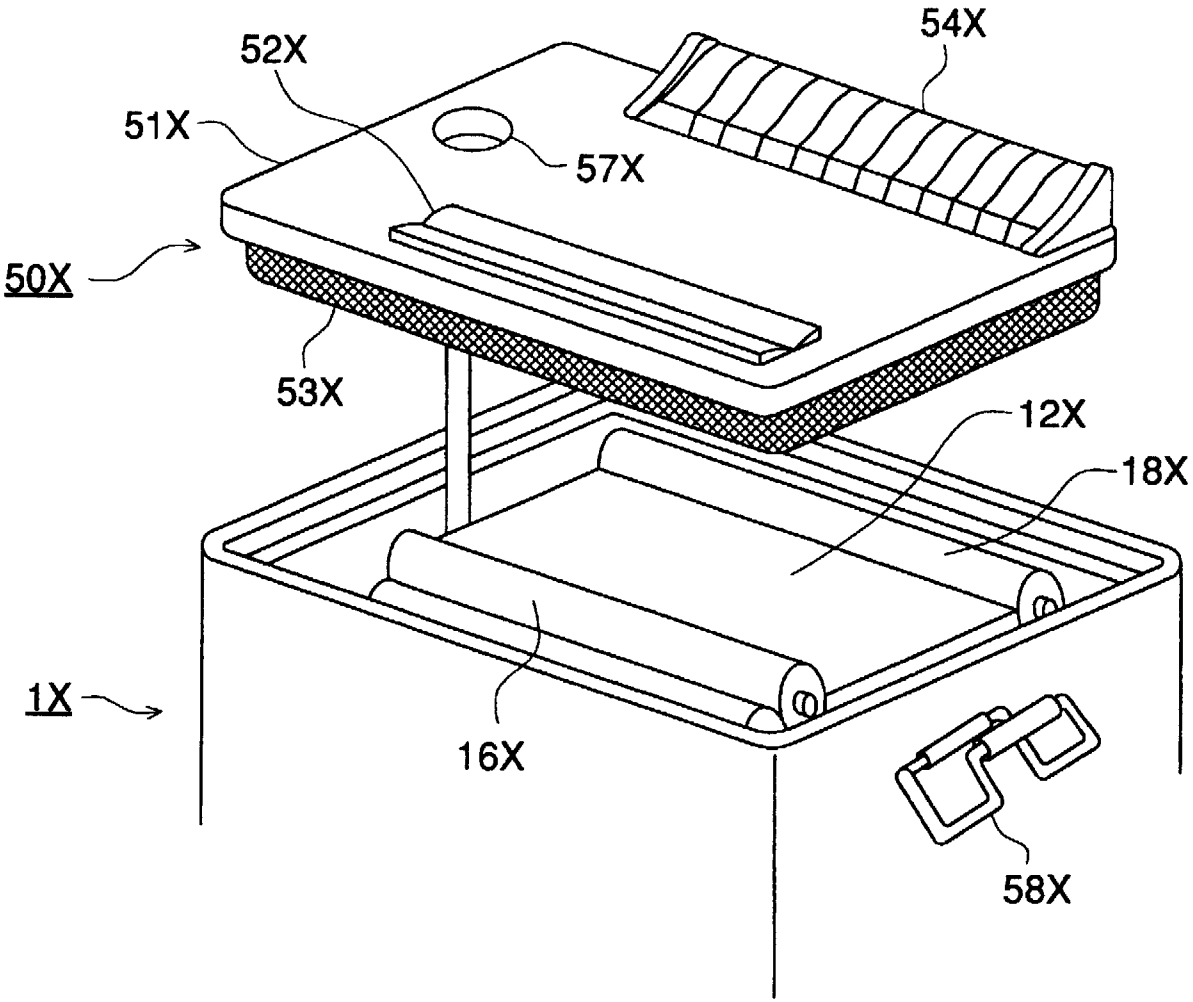
FIG. 14 is a perspective view showing when a lid member of a color developing tank of Example 5 is opened.

The present example employs a color developing tank shown in FIGS. 11 through 14 in place of the color developing tank shown in FIG. 8 in Example 3. The structure of color developing tank shown in FIGS. 11 through 14 will be shown below. FIG. 11 is a schematic drawing of the color developing procesing tank in FIG. 11. FIG. 12 is a perspective view of the color developing procesing tank of the present example when the light-sensitive material is processed wherein a cross-over guid 28 is omitted for easy understanding. FIG. 13 is a cross-sectional of the color developing procesing tank of the present example. FIG. 14 is a perspective view when a lid member of the color developing tank of the present example is opened. Hereunder, only the color developing tank will be explained.

A color developing tank 1X which processes a light-sensitive material is composed of a lower member 13X which regulates the form of the lower side of a processing tank which goes along the conveyance route and which serves as a conveyance guide for the silver halide photographic light-sensitive material, an upper member 12X which regulates the form of the lower side of a processing tank which goes along the conveyance route and which serves as a conveyance guide for the silver halide photographic light-sensitive material and conveyance rollers 16X, 17X and 18X which drives the silver halide photographic light-sensitive material on the conveyance route between the lower member 13Y and the upper member 12X for conveying the silver halide photographic light-sensitive material.

At the side of the color developing tank 1X which processes the light-sensitive material, an auxiliary tank 2X, provided separately from the color developing tank 1X, is provided. A circulation pipe 21X which communicates the color developing tank 1X and the lower portion of the auxiliary tank 2X is formed so that the color developing solution flows. Above the auxiliary tank 2X, a solid processing agent supplying portion 20X is provided. A tablet J supplied from a solid processing agent supplying means 3A passes the solid processing agent supplying portion 20X, and is supplied to the auxiliary tank 2X.

A bar heater 26X is provided in such a manner that it penetrates the upper wall of the auxiliary tank 2X and is immersed in the processing solution inside the auxiliary tank 2X. This heater 26X warms the processing solution in the circulation route of the processing solution and the color developing tank 1X based on temperature sensed by a thermostat housed inside the auxiliary tank 2X (not illustrated). In other words, the heater 26X is a temperature regulating means which keeps the processing solution inside the processing tank 1X in a temperature range suitable for processing (for example, 20° to 55° C.).

A replaceable flat filter 22X is housed in the auxiliary tank 2X in such a manner that it partitions auxiliary tank 2X and the above of the developing solution housing tank 4X. It functions to remove insoluble coagulation in the color developing solution. The lower portion of the developing solution housing tank 4X is connected to the in-feed side of the circulation pump 24X (a circulation means) through the circulation pipe 23X which penetrates a lower wall near the bottom of the developing solution housing tank 4X.

The above-mentioned circulation system is structured by the circulation route of the color developer solution formed by the circulation pipe 21X, the auxiliary tank 2X, the circulation pipe 29X, the developing solution housing tank 4X, the circulation pipe 23X, the circulation pump 24X and a circulation pipe 25X, and the color developing tank 1X. The other end of the circulation pipe 25X which is connected to the out-feed side of the above-mentioned circulation pump 24X penetrates the bottom of the color developing tank 1X. Due to the above-mentioned structure, when the circulation pump operates, the color developing solution is pumped from the auxiliary tank 2X to the color developing tank 1X. The color developing solution is mixed with the color developing solution inside the color developing tank 1X, and then, inserted to the auxiliary tank 2X. Thus, the circulation is continuously repeated.

With regard to each numeral of this example, the volume Vw of the color developing solution housed in the color developing tank 1X which processes a light-sensitive material was 1 liter. The volume Vf of the color developing solution in the circulation route was 4 liters. The circulation flow rate Vc of the color developing solution which occurs due to circulation pump 24W was 10 liters/minute. The total flowing-in cross-sectional area St at the flowing-in port of the processing solution which circulates in the photographic processing was 10 $cm^2$. The aperture area ratio N was 8 $cm^2$/liter.

above a color developing tank 1X, a lid member 50X is provided. The lid member 50X is composed of a lid member main body, a packing member 53X and a movable shutting member 52X. The lid member main body 51X completely covers the color developing tank 1X so that a color developing solution inside the color developing tank 1X is completely shut from outer air substantially. There is provided an insertion port 14X and an exiting port 15X which are defined by a lower member 13X and the upper member 12X. In the lid member main body 51X, an insertion port 55X and an exiting port 56X are provided, at positions each corresponding to the insertion port 14X and the exiting port 15X, which constitute a part of the conveyance route of the silver halide photographic light-sensitive material. Only the above-mentioned insertion port 14X and the exiting port 15X are gas/liquid interfaces of the color developing solution in the color developing tank 1X. At the edge portion of the insertion port 55X, 2 movable shutting member 52, facing each other, are provided. These 2 movable shutting member 52X, having a larger width than the silver halide photographic light-sensitive material, is made of silicon rubber and is capable of being deoformed. These 2 movable shutting member 52X are deformed to the color developing tank side due to the stiffness of the silver halide photographic light-sensitive material, when the silver halide photographic light-sensitive material passes the insertion port 55X. Between these two movable shutting member 52X, the silver halide photographic light-sensitive material passes. On the lid member main body 51X, a receiver 54X for receiving replenisher water supplied to a cross-over roller 72X and for supplying the replenisher water from the exiting port 56X to the color developing tank 1X is provided. At the entire bottom surface of the lid member main body 51X including a portion where the lid member 50 andthe upper portion of the color developing tank 1X, a packing member 53X is provided. On the lid member main body 51X, a driving transferring hole 57 for a driving transferring member 61X which transfers driving force to the conveyance roller 16X, 17X and 18X. The lid member 50X is fixed with a buckle 58X provided in the color developing tank 1X.

Inside a light-sensitive material processing apparatus main body 101T, a replenisher water supplying means 40T is provided near the above-mentioned auxiliary tank 2X. Aforesaid replenisher water supplying means 40T is composed of a replenisher water tank 41T, a bellows pump 42T, an in-feed pipe 43T and an out-feed pipe 44T. Replenisher water W housed in the replenisher tank 41T is in-fed through the in-feed pipe 43T due to the in-feeding effect of the bellows pump 42T. Succeedingly, the replenisher water W, due to the extrusion effect of the bellows pump, passes through the out-feed pipe 44T to be supplied above the processing solution liquid inside the auxiliary tank 2T. The driving motor of the above-mentioned bellows pump 42T is subjected to timing control by means of the replenisher water supplying and controlling means 45T to be driven and rotated so that the replenisher water is replenished intermittently.

The width of the cross-over roller 72X is larger than that of the silver halide photographic light-sensitive material. Replenisher water supplied from the feeding pipe 44T is supplied from the replenisher water supplying nozzle 71X to the cross-over roller 72X. This replenisher water nozzle 71X, by the use of plural nozzle holes, blows replenisher water uniformly over the entire surface of the cross-over roller 72X for supplying. When replenishing water is supplied from the replenisher water supplying nozzles 71X, the cross-over roller 72X is controlled to be rotated. The receiver 54X receives replenisher water supplied to the cross-over roller 72X, and then, replenisher water is supplied to the color developing tank 1X from the exiting port 56X.

The conveyance rollers 16X, 17X and 18X are driven by means of a driving member 61X which transfers a driving force to the conveyance roller 16X, 17X and 18X. A driving transfering member 61X transfers the driving force from a driving roller 64X through a gear 63X provided on a driving gear 64X and a gear 62X provided on the driving transfering member 61X.

The effluent tube 11X is for overflowing the color developing solution from the auxiliary tank 2X. It keeps the liquid surface level constant and is also useful for storing components effluent from the light-sensitive material and to prevent its increase.

EXAMPLE 6

Figure 15:
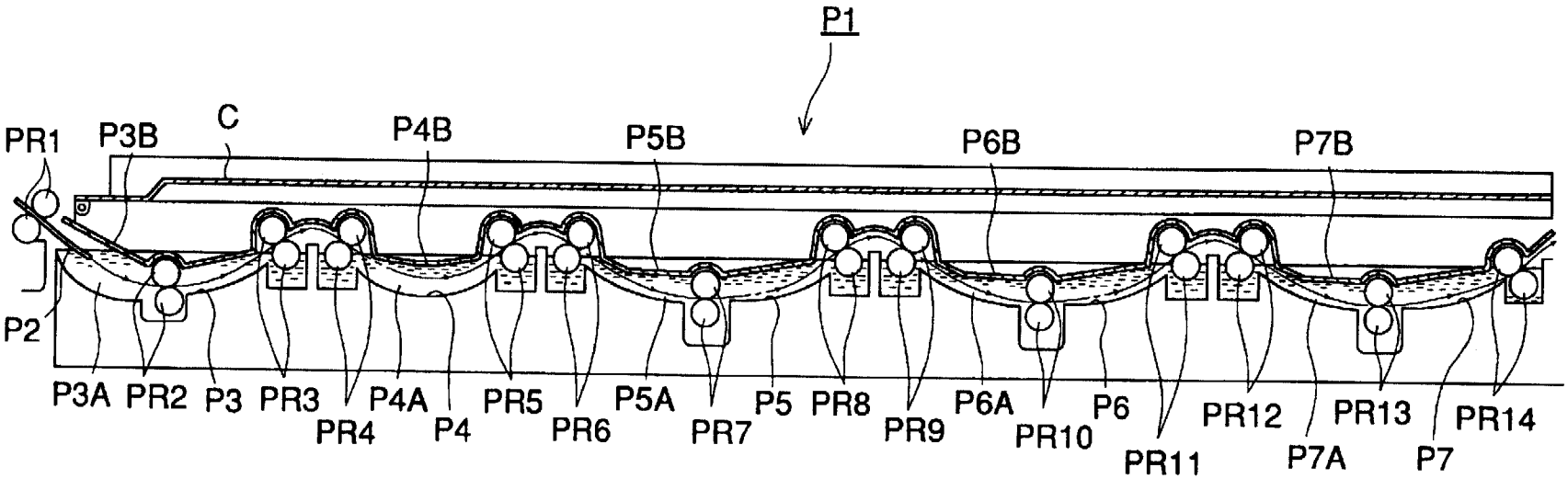
FIG. 15 is a side cross-sectional view of the automatic processing machine of Example 6.
Figure 16:
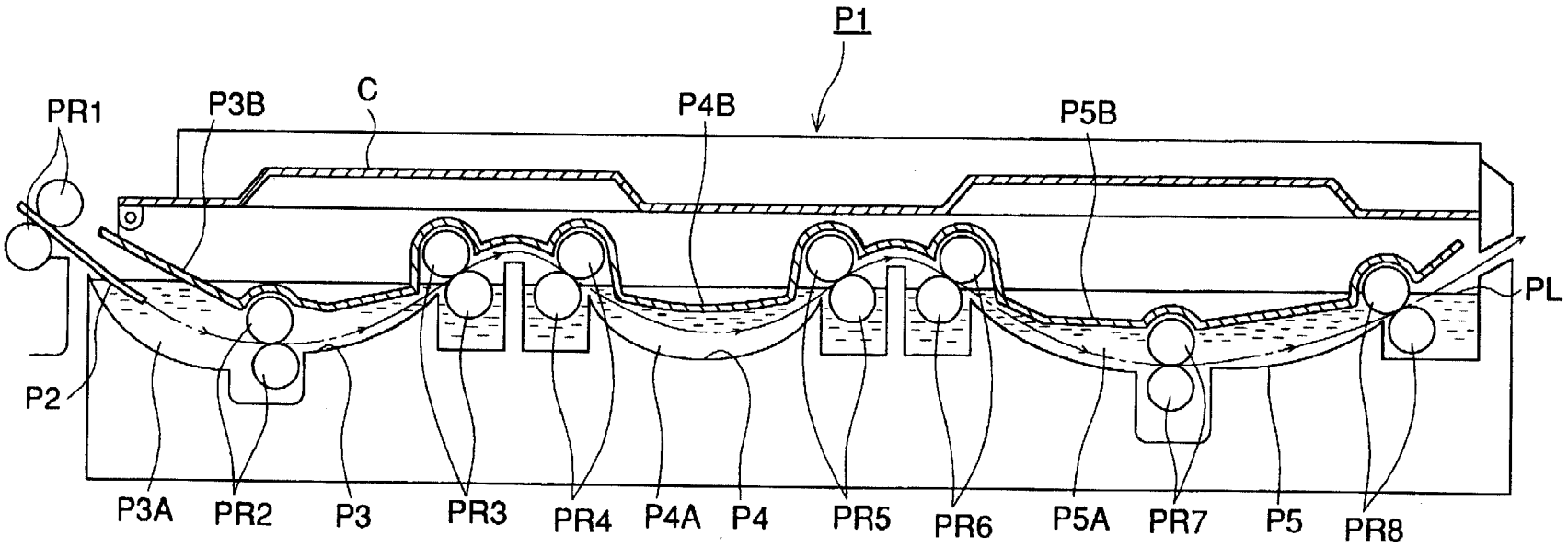
FIG. 16 is a side cross-sectional view from the color developing tank to the first stabilizing processing tank of the automatic processing machine of Example 6.

In the present example, numerals are different from those in Examples 1 through 5. Therefore, be careful on reading the following sentences. FIG. 15 is a schematic cross-sectionview view which is a schematic diagram wherein the cross-section of the automatic processing machine is described in conveyance direction. FIG. 16 is a side cross sectional of the automatic processing machine of the present invention wherein the cross-sectional of the color developing tank P3 through the first stabilizing tank in the conveyance direction are shown. With regard to the processing tanks, a color developing tank P3, a bleach-fixing tank P4 and the first stabilizing tank P5, the second stabilizing tank P6 and the third stabilizing tank P7, for stabilizing processing, are located to the side direction from left along with the conveyance direction of the silver halide photographic light-sensitive material (a photographic paper) P2. In each tank, a color developing solution P3A, a bleach-fixing solution P4A and stabilizing solutions P5A, P6A and P7A are filled. Conveyance route of the light-sensitive material P2 is shown by one-dot chain line. The light-sensitive material is conveyed by the conveyance roller from the inlet port side as shown in PR1 through PR14. In this example, the processing solution in each tank is filled to almost the same level PL.

Three procesing tanks combine to form one tank unit. The height of this tank unit is extremely low compared to conventional automatic processing machines. Each processing tank is covered with an upper member P3B in the color developing tank P3, an upper member P4B in the bleach-fixing tank P4, an upper member P5B in the first stabilizing tank P5, an upper member P6B in the second stabilizing tank P6 and an upper member P7B in the third stabilizing tank P7 so that each processing tank may not overflow due to the processing solution. Due to this, the aperture area is extremely reduced. In addition, tank volume is also reduced.

Due to this, the tank volume of the color developing tank P3 and the bleach-fixing tank P4 is respectively 1 liter, and that of the first stabilizing tank P5, the second stabilizing tank P6 and the third stabilizing tank P7 is respectively 0.8 liter. The above-mentioned upper members P4B, P5B, P6B and P7B define the form of the top of the processing tank which follow the conveyance route, and also serve as the conveyance guide of the silver halide photographic light-sensitive material. Above the above-mentioned upper members are covered with an opening/closing lid C which can be opened/closed.

Figure 17:
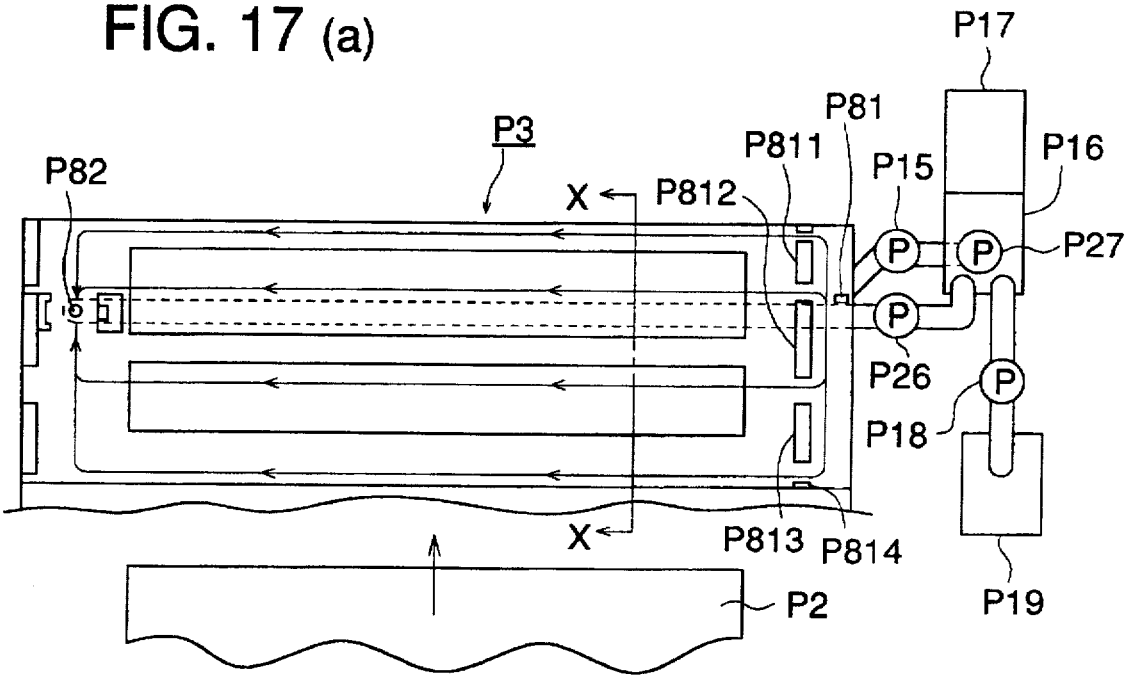
FIG. 17(*a*) is a top view, FIG. 17(*b*) is a side cross-sectional view of the color developing tank of Example 6 and FIG. 17(*c*) is a schematic view of an auxiliary tank.
Figure 17:
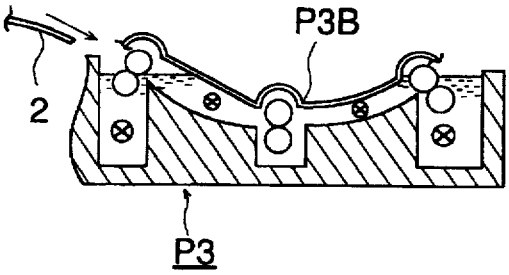
Figure 17:
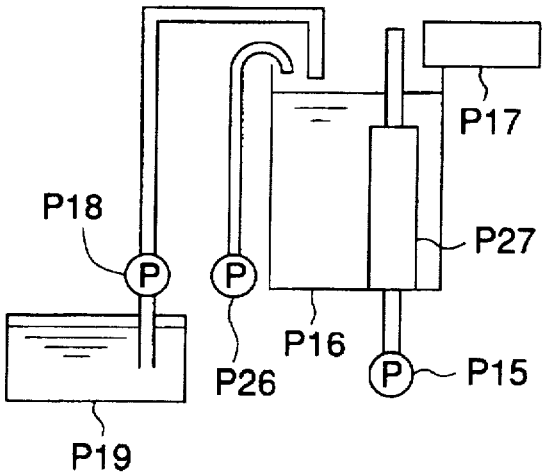

Though not shown in FIG. 15, the automatic processing machine of the present example forms a liquid flow in the vertical direction to the conveyance route shown by a dashed line. This is shown in FIG. 17 which is a figure showing the color developing tank P3 as an example of the processing tank. FIG. 17(*a*) shows the color developing tank P3 from the top, wherein an arrowed line shows the main liquid flow. The color developing solution fed from a feeding-out port P81 of a pump P15 which is a liquid flow forming means and a circulation means passes openings P811, P812, P813 and P814 to become energetically and flows to the left of the figure in a manner that the color developing solution is fed-in a feeding-in port P82, provided at the left edge of the color developing tank P3, which is connected to a pump P26 which is a circulation means located outside the apparatus. The processing solution fed to the pump P26 is returned to the auxiliary tank P16 through a pipe. The processing solution returned to the auxiliary tank P16 is returned to the processing tank by a pump P15 through a filter P27 for filtering. The solid processing agent is supplied from a solid processing supplying means P17 to the auxiliary tank P16. Replenishing water is supplied from a replenisher water tank P19 to the auxiliary tank P16 by means of a pump P18.

FIG. 17(*b*) shows a form of the cross-sectional of FIG. 17(*a*) at X-X. Two rectangles in the vicinity of the center of FIG. 17(*a*) is, as is understood by by FIG. 17(*b*), a lower side of the color developer tank P3 and an inner wall of the color developer tank P3 functioning as a conveyance guide controlling the conveyance of the light-sensitive material P2. The solution is sprayed from the side direction to the conveyance direction of the light-sensitive material P2 to the vertical direction to a paper surface through the above-mentioned openings P11 through P14 as shown in FIG. 17 (*b*). Namely, bundles of liquid flow shown in the above-mentioned apparatus is caused to occur by openings which is formed symmetrically in FIG. 17 (*b*). Therefore, during conveyance route of the light-sensitive material P2, in the case of the color developing tank P3, liquid flow caused to occur in the processing tank region between the feeding-in side conveyance roller PR1 and the feeding-out conveyance roller PR3 generates development promotion effect.

A feeding-in port P82 at the bottom of the processing tank is connected to the circulation pump P26 through a pipe. The circulation pump P26 is connected to the auxiliary tank P16 through a pipe. The auxiliary tank P16 is connected to the circulation pump P15 through a pipe. The circulation pump P15 is connected to the feeding-out port P81 of the processing tank. The circulation pump P26 and the circulation pump P15 are circulation pumps which circulate processing solutions continuously. Its flow rate is continuously variable between 1 to 10 liters/minute, and can be controlled. In the processing tank, an overflow port is provided, whereby the overflow solution remains in the effluent tank. The circulation pump P15 is controlled due to the processing of the light-sensitive material and the supply of the solid processing agent to the auxiliary tank P16. In addition, in the processing tank, there is provided a sensor for the surface of the processing solution, whereby information about solution surface sensed is transferred to the controlling means. The circulation pump P26 is controlled based on information from the processing solution surface sensor about the solution surface of the surface of the processing solution in the processing tank and also based on the control amount to the circulation pump P15.

With regard to each value of this example, the volume Vw of the color developing solution housed in the color developing tank P3 which processes a fight-sensitive material was 1 liter. The volume Vf of the color developing solution in the circulation route was 4 liters. The circulation flow rate Vc of the color developing solution which occurs due to circulation pump P15 and P26 was 10 liters/minute. The total flowing-in cross-sectional area Se at the flowing-in port of the processing solution which circulates in the photographic processing (in this example, the total of the apertures P811, P812, P813 and P814) was 10 $cm^2$. The aperture area ratio N was 8 $cm^2$/liter.

As illustrated in FIG. 17(*c*), the auxiliary tank P16 has the same constitution as the auxiliary tank in FIG. 3 in Example 1, and it has a solid processing agent supplying means P17 in the same manner as in the auxiliary tank in FIG. 7 in Example 2. In a replenisher water tank P19 storing replenisher water used to supply replenisher water to the above-mentioned auxiliary tank P16, there is provided a temperature adjusting means composed of a heater P31 which is a warming means and a temperature sensing sensor, wherein temperature is adjusted to a prescribed temperature (in an experiment described later, 38°±1° C.). A solid processing agent supplying section 20W is provided above the auxiliary tank P16, whereby the tablet J supplied from the solid processing agent supplying means P17 is supplied to the auxiliary tank P16.

A bar heater P32 is provided in such a manner that it penetrates the upper wall of the auxiliary tank P16 and is immersed in the processing solution inside the auxiliary tank P16. This heater P32 warms the processing solution in the circulation route of the processing solution and the color developing tank P5 based on temperature sensed by a thermostat housed inside the auxiliary tank P16 (not illustrated). In other words, the heater P32 is a temperature regulating means which keeps the processing solution inside the processing tank P5 in a temperature range suitable for processing (for example, 20° to 55° C.).

A replaceable flat filter P27 is housed in the auxiliary tank P16. It functions to remove insoluble coagulation in the color developing solution.

Figure 18:
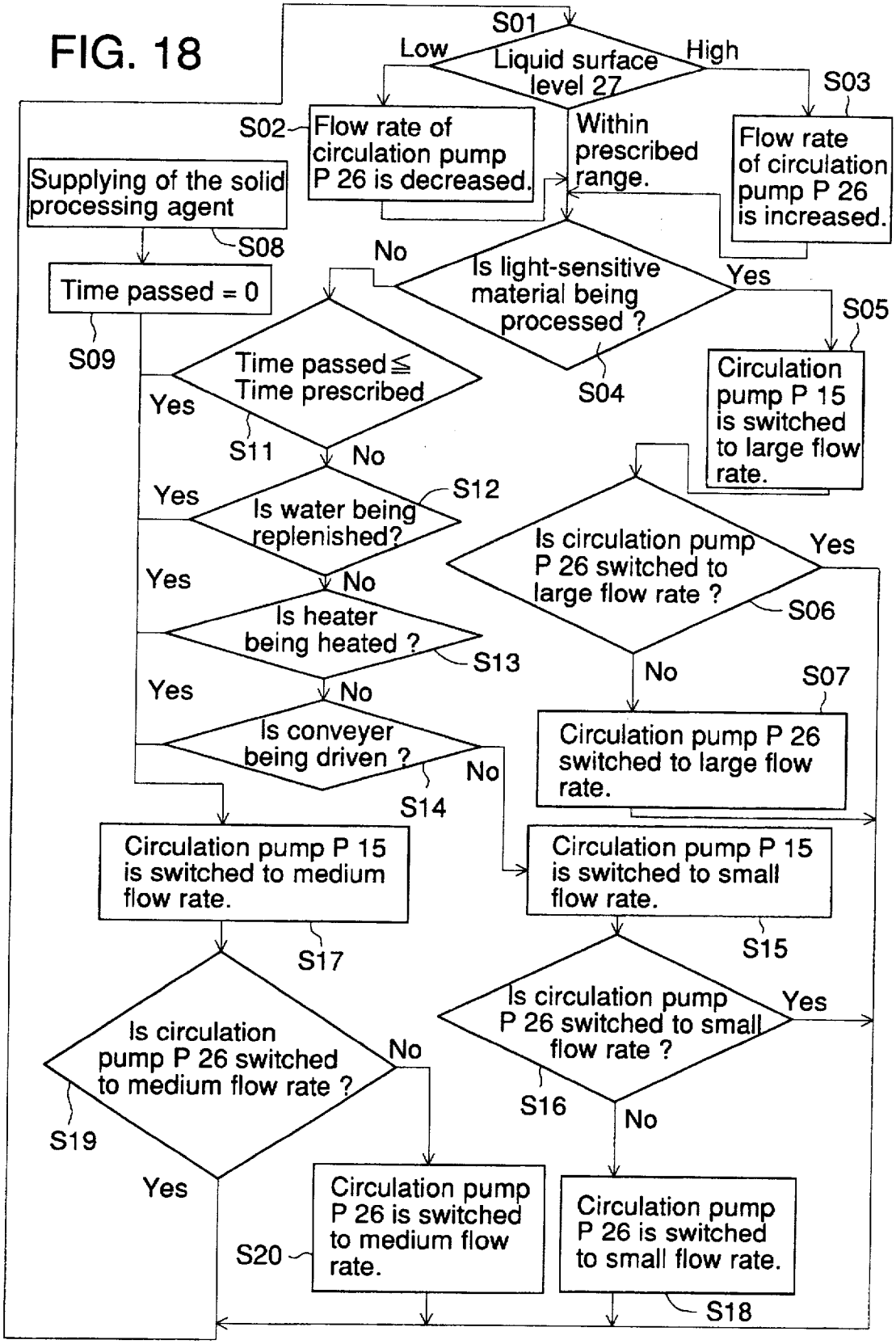
FIG. 18 is a control flow chart showing a control flow of the circulation of the processing solution in the processing tank of the automatic processing machine for Example 6.

FIG. 18 is a control flow of the circulation system of the present example. When the operation switch of the automatic processing machine is pressed, the circulation pump P26 and the circulation pump P15 are driven at a small flow rate. Following this, controllers in the automatic processing machine, such as a controller for the temperature of processing solution, a controller for the conveyance of the light-sensitive material, a controller for the replenishing of the processing agent and a controller for water replenishing are driven. Up to this step, all processing tanks are controlled commonly. After this step is finished, control is conducted for each processing tank, and proceeds to Step S01 in FIG. 18.

In this step S01, the height of the liquid surface sensed by a liquid surface sensor in the processing tank is determined. When the height of the liquid surface is within the prescribed range, the flow continues to step S04. In step S01, when the height of the liquid surface is lower than the prescribed range, advance to step S02, and reduce the flow rate of the circulation pump P26 by a prescribed ratio, and then, advance to step S04. In step S01, when the height of the liquid surface is greater than the in prescribed range, advance to step S03, and increase the flow rate of the circulation pump P26 by a prescribed ratio, and then, advance to step S04. In step S04, determine whether or not the light-sensitive material is being processed. Here, when the light-sensitive material is not being processing, advance to step S11. When the light-sensitive material is being processed, advance to step S05. When the light-sensitive material is being processed, in order to greatly increase the amount of flow rate of the processing solution fed from the slit to a large amount, increase the amount of flow rate of the circulation pump P15 to a large flow rate in step S05 and advance to step S06. In step S06, determine whether or not the circulation pump P26 has already coped with increasing the flow rate. When the circulation pump P26 has already produced an increased flow rate, return to step 01. When the circulation pump P26 has not coped with increasing the flow rate yet, advance to step S07, and increase the flow rate of the circulation pump P26 to the prescribed flow rate and return to step S01.

Incidentally, when advanceing to step S11, determine whether or not a time passed from the solid processing agent is supplied from the solid processing agent supplying means P17 in the auxiliary tank P16 (time by means of a timer which measures time passed from the solid processing agent was supplied from the solid processing agent supplying means finally) is less than a prescribed time. If the time of the timer is less than the prescribed time, advance to step S17, where cause the flow rate of the circulation pump P15 a prescribed middle flow rate, and then, advance to step P19. If the time of the timer is not less than the prescribed time, advance to step S12, where whether or not water is during replenished is judged. If water is during replenishing, advance to step S17, where cause the flow rate of the circulation pump P15 a prescribed middle flow rate, and then, advance to step P19. If water is not replenishing, advance to step P13, where judge whether or not the heater P32 in the auxiliary pump P16 is during heating. If the heater P32 in the auxiliary tank P16 is during heating, advance to step S17 and cause the flow rate of the circulation pump P15 to a prescribed middle flow rate, and then, advance to step S19. If the heater P32 in the auxiliary tank P16 is not during heating, advance to step S14 where determine whether or not a conveyance means which conveys a light-sensitive material in the processing tank operates. If the conveyance means operates, advance to step S17 where cause the flow rate of the circulation pump P15 to a middle flow rate, and then, advance to step S19. If the conveyance means do not operate, advance to step S15 where cause the flow rate of the circulation pump P15 to a prescribed middle flow rate, and then, advance to step S16. In step S16, judge whether or not the circulation pump P26 has coped with the reduction of the flow rate. When the circulation pump P26 has already coped with the reduction of the flow rate, return to step S01. When the circulation pump P26 has not coped with the reduction of the flow rate, advance to step S18, where reduce the flow rate of the circulation pump P26, and then, return to step S01. in step S19, judge whether ,or not the circulation pump P26 has already been switched to middle flow rate. When the circulation pump P26 has already been switched to middle flow rate, return to Step S01. When the circulation pump P26 has not been switched to middle flow rate, advance to Step S20, and then, switch the flow rate of the circulation pump P26 to a prescribed middle flow rate, and then, return to step S01.

Here, if the solid processing agent is supplied from the solid procesing agent supplying means P16, interruption processing is conducted to step 08, and then, advance to step S09. The passing time is set to "0" again (the timer is set to "0" again), and then, advance to step S17.

Due to the above-mentioned control flow, replenishing water circulates in a large amount only when the light-sensitive material is processed so that contributing to increasing the speed of processing. When the light-sensitive material is not processed, due to switching to a low flow rate or the middle flow rate, oxidation and deformation of the processing agent component which is caused by switching to a large flow rate are prevented. By switching to a small flow rate or a middle flow rate, the following problems can be solved: A problem of processing unevenness due to the occurrence of a high density processing agent component solution in the vicinity of a solid processing agent undissolved portion due to not circulating of the proccessing solution, oxidation or deformation of the processing agent component and coagulation of the processing component and coagulation of processing agent components having low disolubability. A problem of uneven temperature and insufficient adjusting of temperature because only around the heater is warmed. A problem of uneven processing due to the occurrence of a low density processing agent component solution and increase of the density of a processing solution because replenisher water is not mixed when water is replenished. A problem that components coagulated onto conveyance rollers are not sufficiently dissolved and diffused when conveyance rollers PR2 through PR16 are driven per a prescribed time (in a preferable example, 30 seconds for 10 minutes, which is the same as in an experiment described later) for preventing swelling of components.

Incidentally, for evaluating both experiments, it is preferable to stand a flag following the results evaluated by another CPU and the results read by the flag is adopted because evaluation can be conducted rapidly. In addition, the large flow rate was set to be 10 liters/minute, the middle flow rate was set to be 5 liters/minute and a low flow rate was set to be 1 liter/minute in advance respectively.

Controlling other than the above-mentioned circulation means will be explained as follows.

It is controlled so that the solid processing agent is supplied in a prescribed amount every time the processing amount of the light-sensitive material, sensed by a light-sensitive material processing amount sensing means provided, for sensing the processing amount of the light-sensitive material, at the inlet port of the automatic processing machine is the multiple amount of the prescribed processing amount of the light-sensitive material per one supply cycle. Incidentally, the processing amount of the light-sensitive material per supply cycle is calculated from a prescribed unit amount per supply cycle and the replenishing amount of the solid processing agent per 1 $m^2$ of the light-sensitive material processed.

With regard to temperature adjustment, when the sensed temperature of a thermostat in the auxiliary tank P16 is (a prescribed temperature–a prescribed deviation temperature) or less, the heater P32 in the auxiliary tank P16 is warmed at 100% of heater's capacity. When the sensed temperature of a thermostat in the auxiliary tank P16 is (a prescribed temperature–a prescribed deviation temperature) or more and the prescribed temperature or less, the heater P32 in the auxiliary tank P16 is warmed at 95% of heater's capacity. When it is at the prescribed temperature or more, the temperature is adjusted to be the prescribed temperature by switching off the heater P32 in the auxiliary tank P16. In addition, when the sensed temperature of a thermostat in the auxiliary tank P16 is (a prescribed temperature−a prescribed danger deviation temperature) or less and (a prescribed temperature+a prescribed danger deviation temperature) or more, alarm display is shown so that processing is controlled to be prohibited. Incidentally, the prescribed danger deviation temperature is larger than the prescribed deviation temperature.

With regard to the supply of replenisher water, it is controlled every time the processing amount of light-sensitive material reaches a whole multiple of one prescribed unit amount, dissolved water supplied per prescribed unit amount is replenished and that, every time the evaporated water amount reaches a whole multiple of one prescribed unit amount, a prescribed mount of distilled water is replenished. Incidentally, the processing amount of the light-sensitive material per one supply cycle is calculated from a prescribed unit amount per one supply cycle and the replenishing amount of the solid processing agent per 1 $m^2$ of the light-sensitive material processed.

In addition, it is controlled that conveyance rollers PR2 through PR16 are driven at regular intervals so that any components coagulated on any conveyance roller should not be enlarged (preferably, 30 seconds per every 10 minutes). Due to this, when the silver halide photographic light-sensitive material is processed inside the processing tank, processing property is enhanced due to strong circulation flow. When a solid processing agent and replenishing water are supplied while the silver halide photographic light-sensitive material is not processed inside the processing tank, circulation flow in an extent that deterioration of the processing agent (specifically, deterioration of the developing agent) is not accelerated is caused. Therefore, it was confirmed that keeping of high processing property (especially, developing property) and reduction of the air oxidation of the processing solution could be simultaneously achieved.

When the silver halide photographic light-sensitive material is subjected to photographic processing, by satisfying Vw≦Vf (Vw (liter) means a volume of the developing solution housed in the above-mentioned developing tank and Vf (liter) means a volume of the developing solution located in the above-mentioned circulation route), the flow rate of the processing solution in the photographic developing tank can be increased and the flow rate of the processing solution in the circulation route can be reduced. Accordingly, in the developing tank which develops the silver halide photographic light-sensitive material by immersing in the developing solution, improvement of development processability and reduction of air oxidation of the developing agent in the circulation route can be coexistence.

In addition, by providing 2 or more nozzle rows which blow the developing solution to the light-sensitive surface of the silver halide photographic light-sensitive material conveyed along a prescribed conveyance route in the developing tank, each having several nozzles, wherein each adjoining nozzle rows are slid and by providing aforesaid nozzles horizontally to the conveyance surface of the silver halide photographic light-sensitive material and vertical to the conveyance direction, the occurrence of uneven developing in a parallel direction of a conveyance direction of the silver halide photographic light-sensitive material can be prevented.

Since a lid member which constitutes a part of the conveyance route and which has an insertion port and an exit port interrupts substantially the developing solution from air outside, gas/liquid interface does not substantially exist other than the insertion port and the exit port. Therefore, the area of the gas/liquid interface of the developing solution housed in the developing tank can noticeably reduced so that oxidation of the developing agent can remarkably be inhibited.

In addition, by washing the developing solution adhered on the cross-over roller with this replenishing solution, crystallization on the surface of rollers and the occurrence of insoluble can be prevented even when an operator does not remove cross-over rollers every day for washing. In addition, since crystallization on the surface of rollers and the occurrence of insoluble can be prevented, deterioration of images on a low density portion of the silver halide photographic light-sensitive material due to oxidation of the developing agent and reduction of development processability due to the reduction of the developing agent can be prevented so that stable processing property can be maintained.

What is claimed is:

1. An automatic processor for processing a silver halide photographic light-sensitive material with a processing solution, the processor comprising:

a processing tank containing the processing solution for processing the material;

a circulating path for circulating the processing solution, the circulating path connecting the processing tank; and a supplying means for supplying a solid composition to the processing tank or the path, wherein the following expression is satisfied:

$$V_w \leqq Vf$$

where $V_w$ represents an amount (liter) of the processing solution in the processing tank and Vf represents an amount (liter) of the processing solution in the path.

2. The processor of claim 1, wherein the circulating path comprises:

a processing solution storing tank for storing a processing solution; and a circulating means for circulating the processing solution in the processing tank and the processing solution storing tank.

3. The processor of claim 1, wherein the following expression is satisfied:

$$5\times V_w \leqq Vc \leqq 40\times V_w$$

where Vc represents an amount (liter) of circulating processing solution in a minute in the path and Vw represents an amount (liter) of the processing solution in the processing tank.

4. The processor of claim 1, wherein the following expression is satisfied:

ti $0.5\times Se \leqq Vc \leqq 40\times Se$ where Vc represents an amount (liter/min.) of circulating processing solution in the path and St represents a total sectional area ($cm^2$) at an inlet where the processing solution flows into the processing tank.

5. The processor of claim 1 further comprising a conveying means for conveying the material in a conveying path formed inside the processing tank, wherein a processing vessel inside the processing tank is formed in a shape following the conveying path.

6. The processor of claim 5, wherein a part of an inner wall of the processing tank is a conveying guide for guiding the material.

7. The processor of claim 4, wherein the inlet of the processing tank for the circulating processing solution is formed by a nozzle for spraying the processing solution to a photosensitive surface of the material.

8. The processor of the claim 7 further comprising a conveying means for conveying the material in a conveying path formed inside the processing tank, wherein the nozzle is made in the form of a multiple-hole type or slit type, an angle between a direction that the processing solution flows from the nozzle into the processing tank and a conveying direction of the material conveyed by the conveying means, is not less than 30, and not more than 150.

9. The processor of the claim 7, further comprising a conveying means for conveying the material in a conveying path formed inside the processing tank, wherein the nozzle has at least two nozzle rows in which a plurality of nozzles are provided in a direction parallel to a conveyance surface of the material and perpendicular to a conveying direction of the material, and the nozzle rows adjacent to each other have a different phase each other.

10. The processor of the claim 1, further comprising a conveying means for conveying the material in a conveying path formed inside the processing tank, wherein a plurality of inlets where the processing solution flows into the processing tank are substantially distributed throughout the conveying path.

11. The processor of the claim 1, wherein the following expression is satisfied:

$$N=St/Vt \leqq 12\ cm^2/liter,$$

where N represents an opening area ratio of the processing solution, St ($cm^2$) represents a sum of gas/liquid interface area of the processing tank and gas/liquid interface area of the processing solution stored in a portion connecting the processing tank, and Vt (liter) represents a sum of a capacity of the processing tank and a capacity of the processing solution stored in a portion connecting the processing tank.

12. The processor of the claim 1, wherein the amount Vc (liter) of circulating processing solution in a minute in the circulating path is variable according to an operational condition.

13. The processor of the claim 1 further comprising a replenishment water supply means for supplying water to the processing tank or the circulating path.

14. The processor of the claim 13 further comprising a cross-over roller provided on an upper position connecting the processing tank, for conveying the material from the processing tank.

15. The processor of claim 14, wherein the water supplying means supplies water to the cross-over roller through a nozzle.

16. The processor of claim 14, further comprising a moisture separation means for separating water from an outside air to generate water, wherein a part of replenishment water is water generated by the moisture separation means.

17. The processor of claim 1, the processor further comprising:

a conveying means for conveying the material in a conveying path formed inside the processing tank; and a cover member for substantially isolating the processing solution in the processing tank from an outside air, wherein the cover member constitutes a part of the conveying path, and has an inserting port and a discharging port for the material.

18. The processor of claim 17, wherein the cover member is detachably attachable to the processing tank.

19. The processor of claim 17, wherein the cover member or the processing tank includes a packing material provided on a portion where the cover member contacts with the processing tank.

20. The processor of claim 17 further comprising a movable isolating means provided an inserting inlet of the cover member for the material, for isolating the processing solution inside the processing tank from an outside air when the material does not pass through the inserting inlet.

* * * * *